US010267080B1

(12) United States Patent
Lamb et al.

(10) Patent No.: US 10,267,080 B1
(45) Date of Patent: Apr. 23, 2019

(54) DEVICE FOR COORDINATED CONTROL AND OPERATION OF DOUBLE DOORS

(71) Applicant: L&L CDC, LLC, Monterey Park, CA (US)

(72) Inventors: Larry Lamb, La Crescenta, CA (US); Alice Lee, La Crescenta, CA (US); Dennis Lee, Monterey Park, CA (US)

(73) Assignee: L&L CDC, LLC, Monterey Park, CA (US)

( * ) Notice: Subject to any disclaimer, the term of this patent is extended or adjusted under 35 U.S.C. 154(b) by 0 days.

(21) Appl. No.: 15/730,635

(22) Filed: Oct. 11, 2017

(51) Int. Cl.

| | |
|---|---|
| ***E05F 17/00*** | (2006.01) |
| ***E05F 11/08*** | (2006.01) |
| ***A47B 88/40*** | (2017.01) |
| ***A47B 96/16*** | (2006.01) |

(52) U.S. Cl.
CPC ..... *E05F 17/004* (2013.01); *A47B 88/40* (2017.01); *A47B 96/16* (2013.01); *E05F 11/08* (2013.01); *A47B 2210/0056* (2013.01); *E05F 2017/008* (2013.01)

(58) Field of Classification Search
CPC ... E05F 17/004; E05F 2017/008; E05F 11/08; E05F 2017/005; E05F 2017/007
USPC ..... 49/104, 109, 114, 116, 122
See application file for complete search history.

(56) References Cited

U.S. PATENT DOCUMENTS

| | | | | |
|---|---|---|---|---|
| 484,121 A | | 10/1892 | Stein | |
| 657,347 A | * | 9/1900 | Homan | A47B 49/004 292/262 |
| 835,984 A | | 11/1906 | Reis | |
| 1,579,751 A | | 4/1926 | Bickley | |
| 1,824,109 A | | 9/1931 | Allard et al. | |
| 1,870,964 A | * | 8/1932 | Rousseau | E05F 17/004 49/103 |
| 1,900,176 A | * | 3/1933 | Flewell | E05F 17/004 49/109 |
| 1,996,064 A | * | 4/1935 | Crist | E05F 17/004 49/101 |
| 2,032,803 A | * | 3/1936 | Hunter | E05F 17/004 292/263 |
| 2,465,555 A | | 3/1949 | Smith | |
| 2,598,814 A | | 6/1952 | McAfee | |
| 2,997,041 A | * | 8/1961 | Wolske | F24C 15/022 126/191 |
| 3,009,458 A | * | 11/1961 | Pearce | A47B 96/16 126/190 |
| 3,372,965 A | | 3/1968 | Hideki | |
| 3,895,461 A | | 7/1975 | Maynard, Jr. et al. | |
| 3,895,849 A | | 7/1975 | Zehr | |
| 4,653,229 A | | 3/1987 | Feucht et al. | |
| 6,324,787 B1 | * | 12/2001 | Burr | E05F 17/00 49/109 |
| 6,449,904 B1 | | 9/2002 | Paasonen | |
| 8,226,180 B2 | * | 7/2012 | Patil | E05F 17/004 312/324 |
| 9,109,388 B2 | | 8/2015 | Tyler et al. | |

(Continued)

*Primary Examiner* — Marcus Menezes
(74) *Attorney, Agent, or Firm* — Milord A. Keshishian

(57) ABSTRACT

A device for coordinated control and operation of double doors having a plate with a rectilinear motion that is associated with links with adjustable lengths that connect the plate to the double doors, with both the first and the second doors opened when one of the doors is opened and sequentially closed when one of the doors is closed.

17 Claims, 31 Drawing Sheets

(56) References Cited

U.S. PATENT DOCUMENTS

| | | | | |
|---|---|---|---|---|
| 2005/0016068 | A1* | 1/2005 | Hoskeer | E05F 17/004 49/340 |
| 2010/0154309 | A1* | 6/2010 | Shibata | B60R 7/04 49/338 |
| 2015/0197976 | A1* | 7/2015 | Talbot | F16H 21/44 74/89 |

* cited by examiner 196
194
188

230
242
192
232
198
200
190
226

212
210
204

230
208
214
242
232
202
206
226

DEVICE FOR COORDINATED CONTROL AND OPERATION OF DOUBLE DOORS

CROSS-REFERENCE TO RELATED APPLICATIONS

All documents mentioned in this specification are herein incorporated by reference to the same extent as if each individual document was specifically and individually indicated to be incorporated by reference.

It should be noted that throughout the disclosure, where a definition or use of a term in any incorporated document(s) is inconsistent or contrary to the definition of that term provided herein, the definition of that term provided herein applies and the definition of that term in the incorporated document(s) does not apply.

BACKGROUND OF THE INVENTION

Field of the Invention

One or more embodiments of the present invention relate to a device for coordinated control and operation of double doors.

Description of Related Art

Conventional mechanisms for control of double doors of an enclosure such as a doubled door cabinet are well known and have been in use for a number of years. Regrettably, most are large, bulky (have high height profile), complex, and use many moving parts (such as springs, etc.) that would require replacement after a short use. Others lack the ability to sequencing closure or opening of the double doors.

Accordingly, in light of the current state of the art and the drawbacks to current conventional mechanisms for controlling double doors mentioned above, a need exists for a device for coordinated control and operation of double doors that would generally be inconspicuous, would have low profile (e.g., lower height and small form factor that would not take much space from the storage within which it is installed and operates), would be simple with the least number of parts, and would be adapted for sequence closure of the double doors. Still further, a need exists for a device for coordinated control and operation of double doors that would not obstruct access to the enclosure when doors are at a fully open position.

BRIEF SUMMARY OF THE INVENTION

A non-limiting, exemplary aspect of an embodiment of the present invention provides a device for coordinated control and operation of double doors, comprising:

a plate that is connected with a linear motion facilitator;

adjustable links that connect the plate to respective a first door and a second door;

the plate is comprised of:

a first and a second pivot openings that are connected to adjustable links; and connection openings for connection of the plate with the linear motion facilitator;

wherein: both the first and the second doors are opened when one of the first or the second door is opened and are closed when one of the first or the second door is closed.

Another non-limiting, exemplary aspect of an embodiment of the present invention provides a device for coordinated control and operation of double doors, comprising:

a plate with a rectilinear motion;

links with adjustable lengths that connect the plate to the double doors;

wherein: both the first and the second doors are opened when one of the doors is opened and sequentially closed when one of the doors is closed.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

Figure 1A:
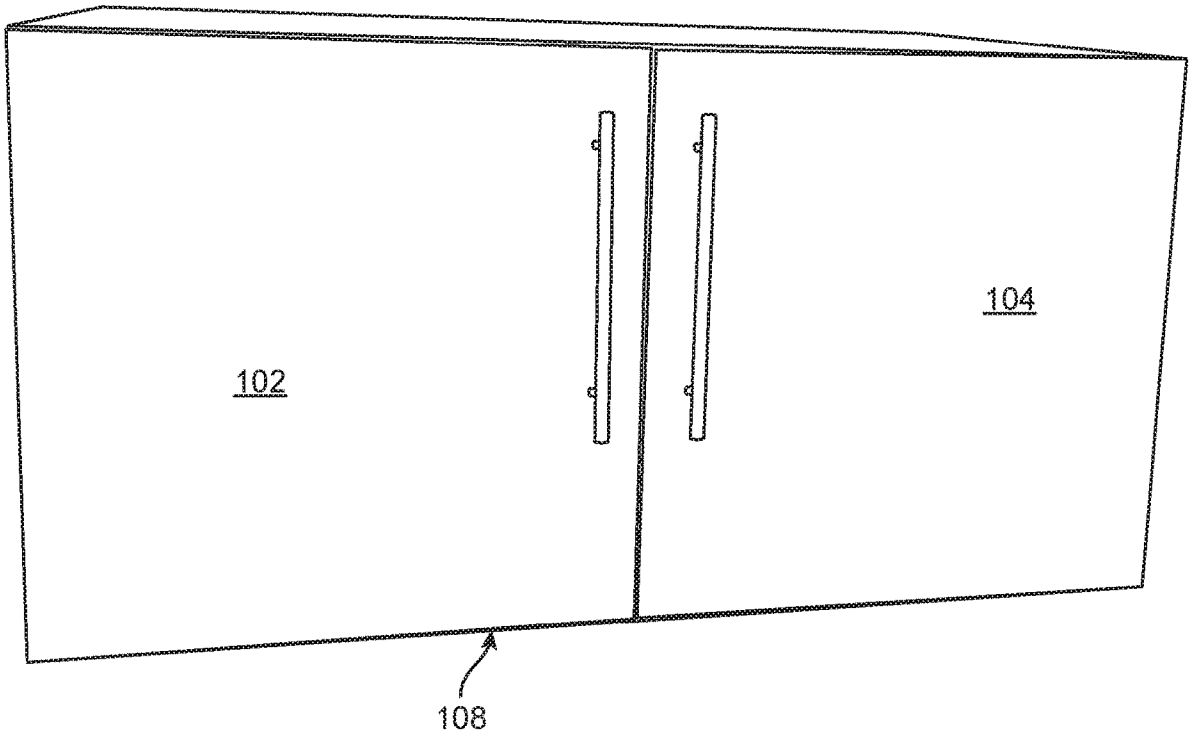
FIG. 1A to 1R-6 are non-limiting, exemplary illustrations an embodiment of a device of the present invention for coordinated control and operation of double doors in accordance with one or more embodiments of the present invention.

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

The present invention has recognized that most conventional mechanisms for control of double doors have flawed geometry that tend to exert large forces on doors and door hinges at incorrect angles during operation of the doors. The present invention has recognized that improper application of forces at incorrect angles due to flawed geometry tend to exert undue high pressures (or stress or strain) on the doors and hinges, resulting in faster wear. As importantly, due to overall flawed geometry, modification of contact points to reduce stress on doors/hinges tend to obstruct access to the enclosure when doors are at a fully open position.

The present invention has further recognized that the flawed geometry of the conventional mechanisms also tend to exert large forces on the mechanisms themselves at incorrect angles during operation of the doors. That is, improper conventional geometry for double door control tends to destabilize the mechanism when transferring application of force on the first door to the second. In other words, improper applied force vectors tend to destabilize the mechanism by application of unwanted potential torque (twisting force) on moving parts of the conventional mechanisms, resulting in faster wear of components.

Accordingly, one or more embodiments of the present invention provide a device for coordinated control and operation of double doors with proper geometry that move doors without undue high pressures (or stress or strain) on the doors and their hinges, and without undue high pressures (or stress or strain) on the device itself, providing a stable, steady operation of the mechanism and doors.

Additionally, one or more embodiments of the present invention provide a device for coordinated control and operation of double doors that is generally inconspicuous, has low profile (e.g., has low height and small form factor that does not take much space from the storage within which it is installed and operates), and that is simple to manufacture and install with the least number of parts. Further, One or more embodiments of the present invention provide a device for coordinated control and operation of double doors that may be adapted for sequence closure of the double doors. Still further, one or more embodiments of the present invention provide a device for coordinated control and operation of double doors that does not obstruct access to the enclosure when doors are at a fully open position.

Figure 1B:
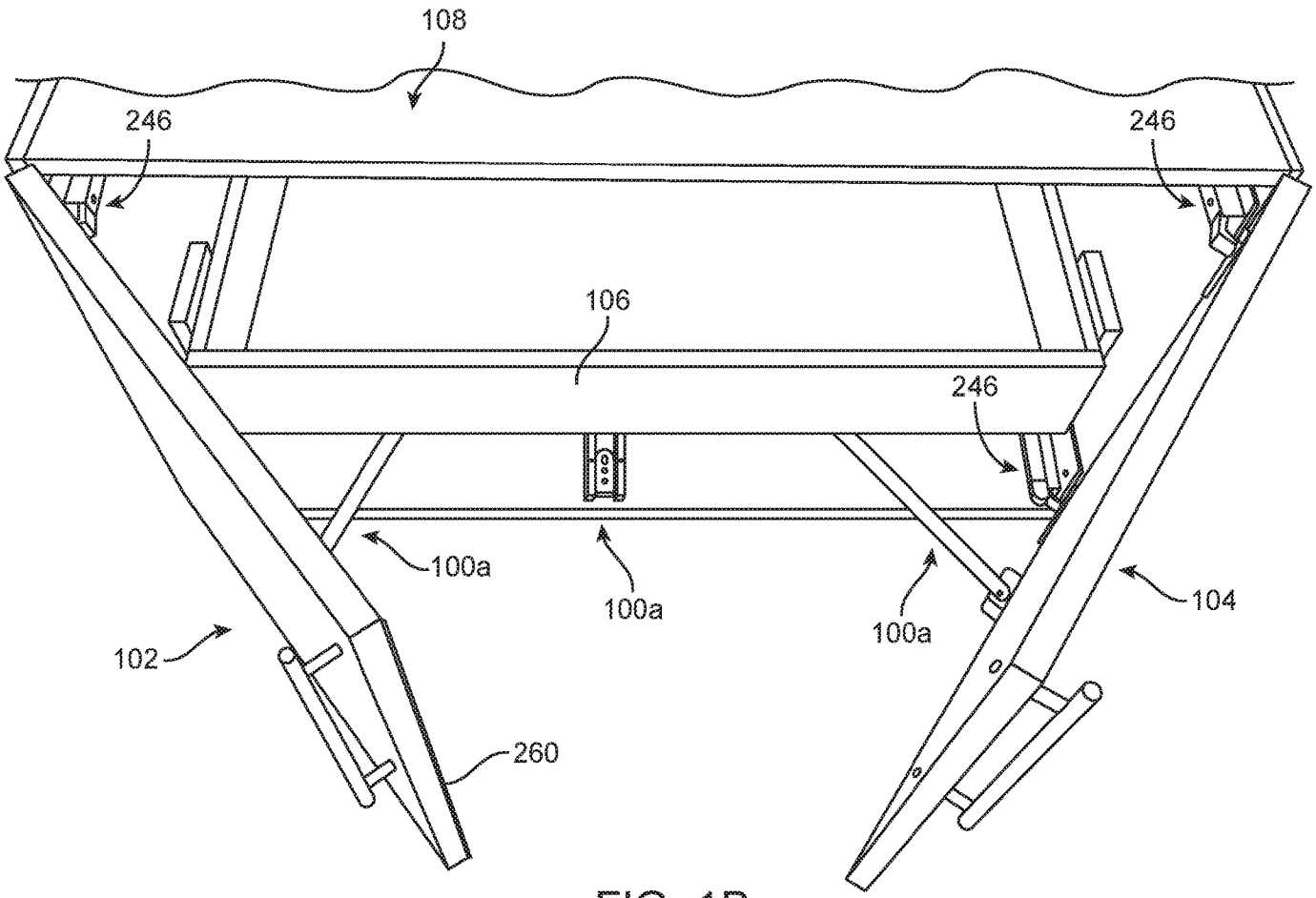
Figure 1C:
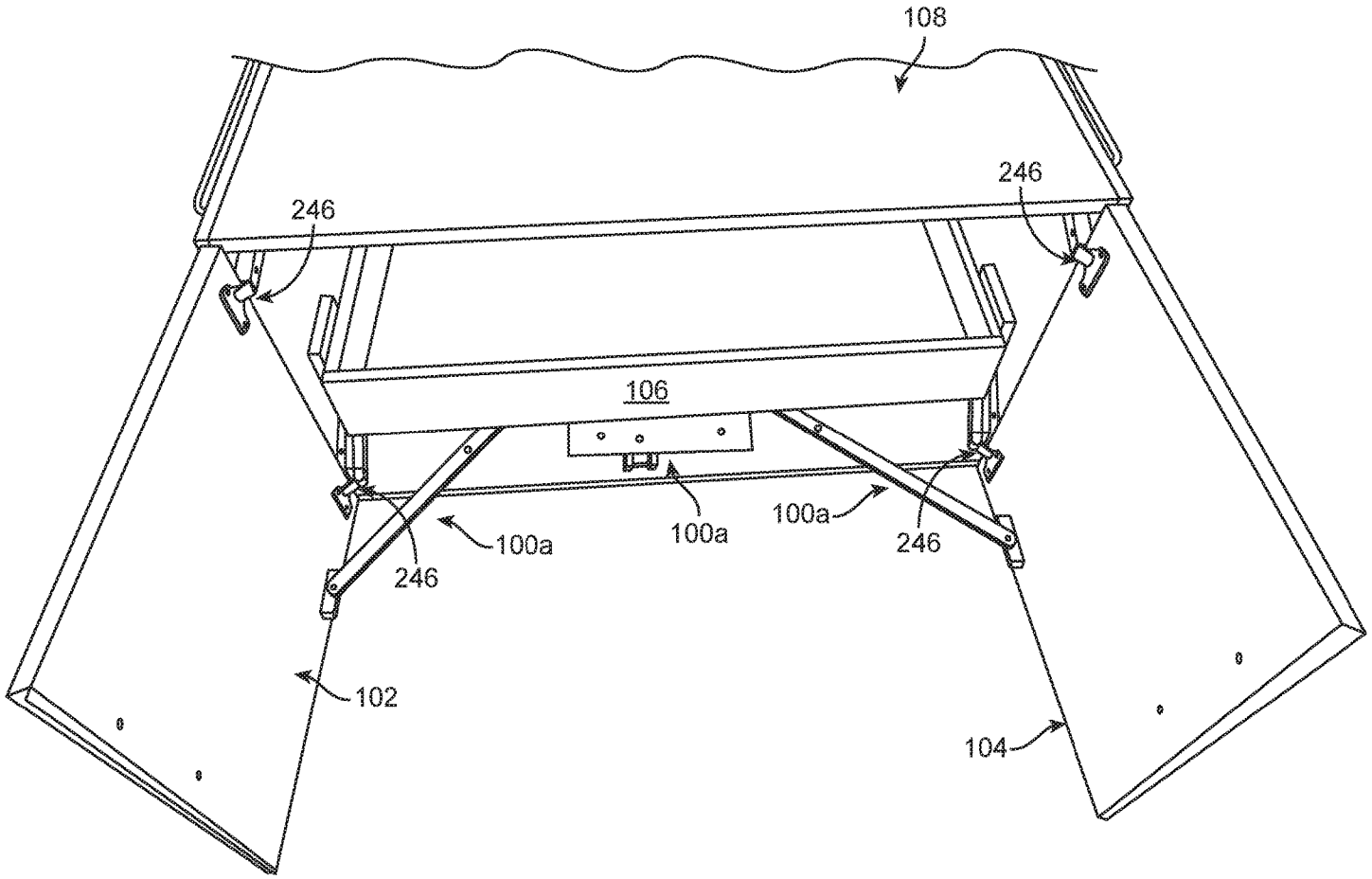

FIGS. 1A to 1E are non-limiting, exemplary illustrations of an exemplary cabinet comprised of an embodiment of a device of the present invention for coordinated control and operation of double doors (from closed to open position) in accordance with one or more embodiments of the present invention. FIGS. 1A to 1C progressively illustrate coordinated operations of double doors 102 and 104 from a closed (FIG. 1A) to a fully open position (FIG. 1C). Accordingly, one or more embodiments of the present invention provide a device 100*a* (FIGS. 1B and 1C) that enable users to open both doors 102 and 104 of cabinet 108 while pulling open only one of the doors (102 or 104) with only one hand.

Further, one or more embodiments of the present invention provide a device 100*a* that enable users to close both doors 102 and 104 of cabinet 108 while closing only one of the doors (102 or 104) with only one hand. Therefore, device 100*a* enables one hand operation of both doors 102 and 104.

Figure 1D:
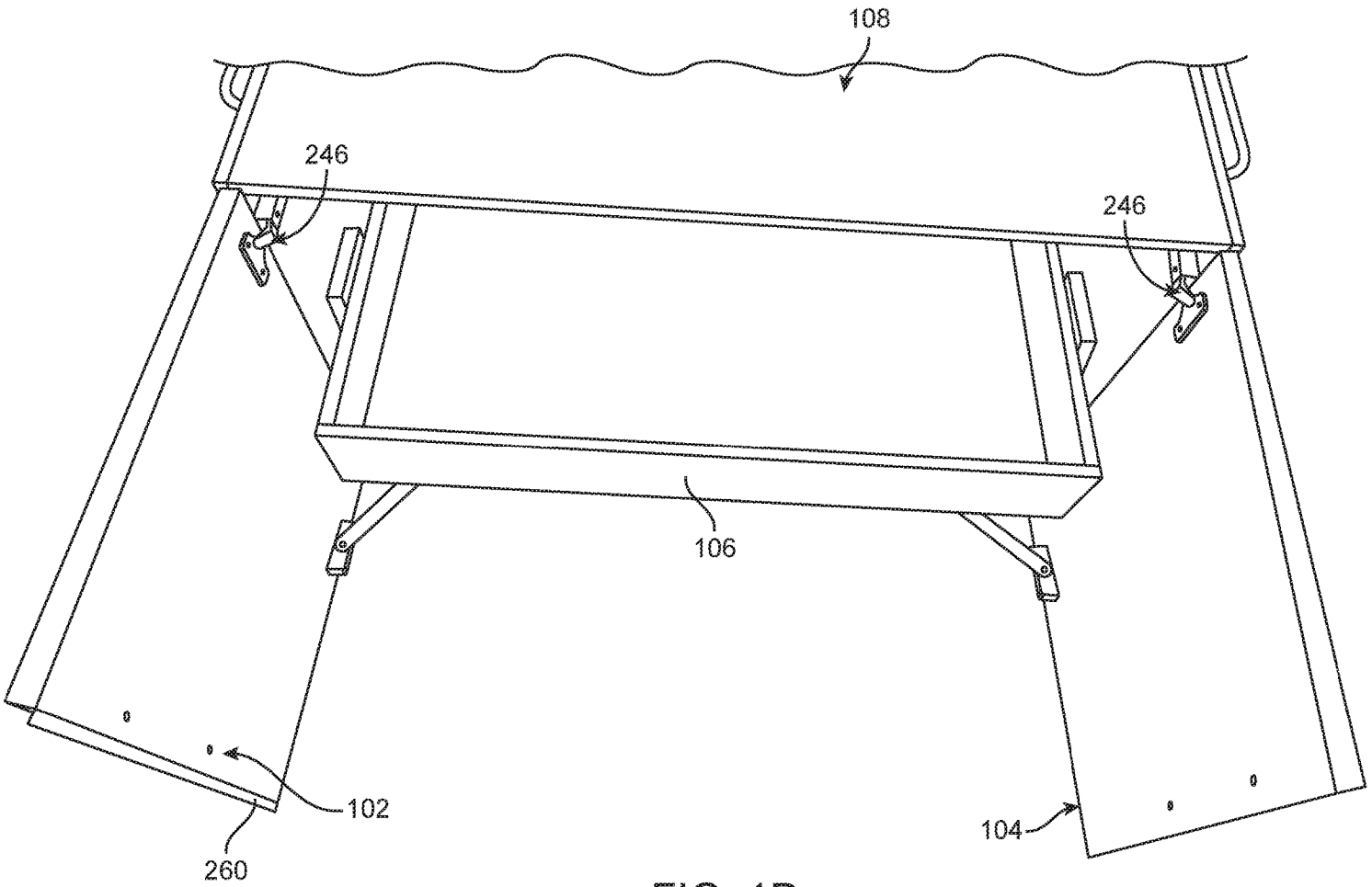
Figure 1E:
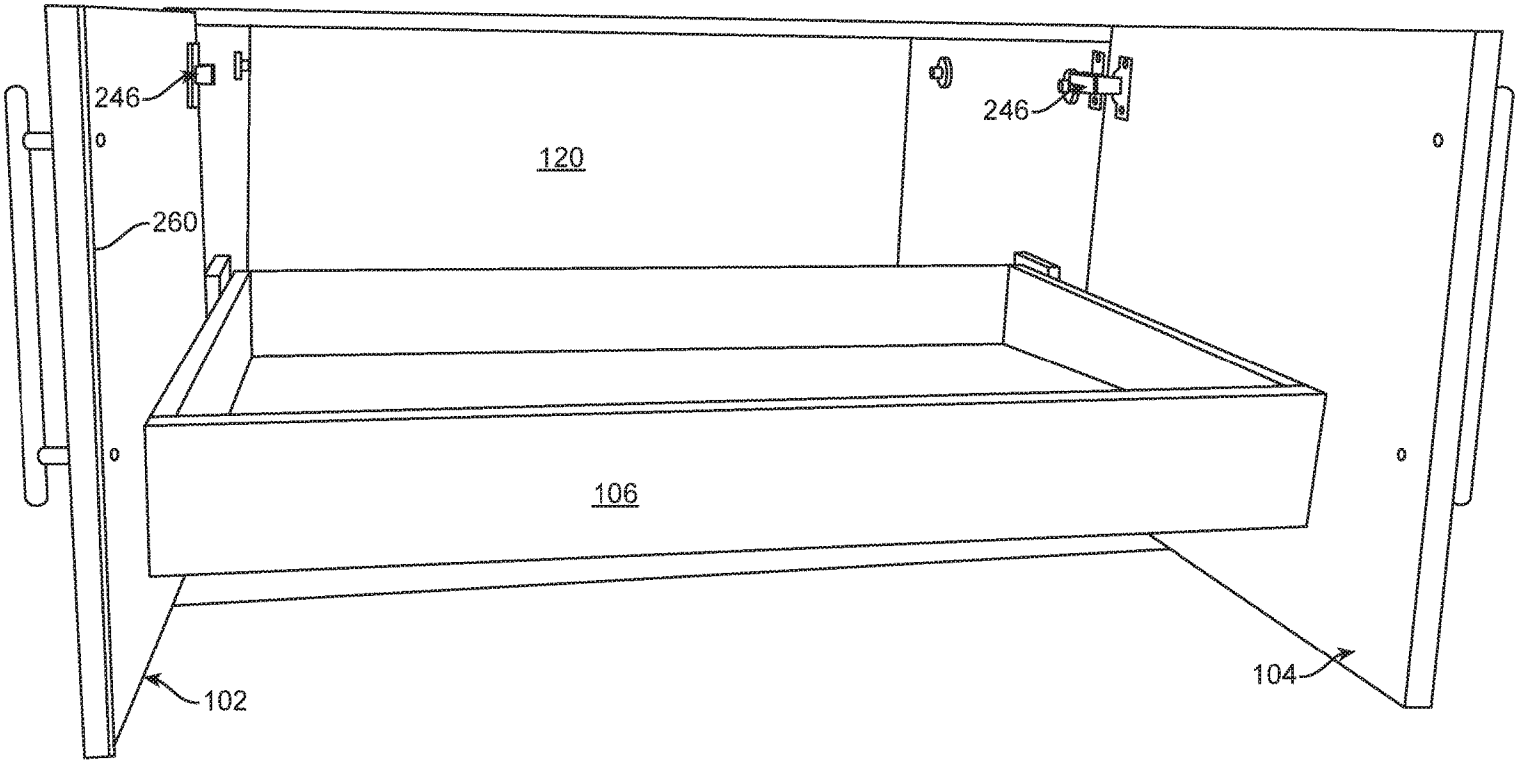

As detailed below, the opening and closure of doors 102 and 104 may be sequenced or concurrent. As best illustrated in FIGS. 1D and 1E, once doors 102 and 104 are fully opened, a drawer 106 may be freely moved out from cabinet 108. Sequencing of door operations is needed when astragals 260 are used on one of the two doors to prevent dust intrusion. The reason sequencing is required is to allow the door with the astragal to close first so that the second door will properly lap the astragal.

Figure 1F:
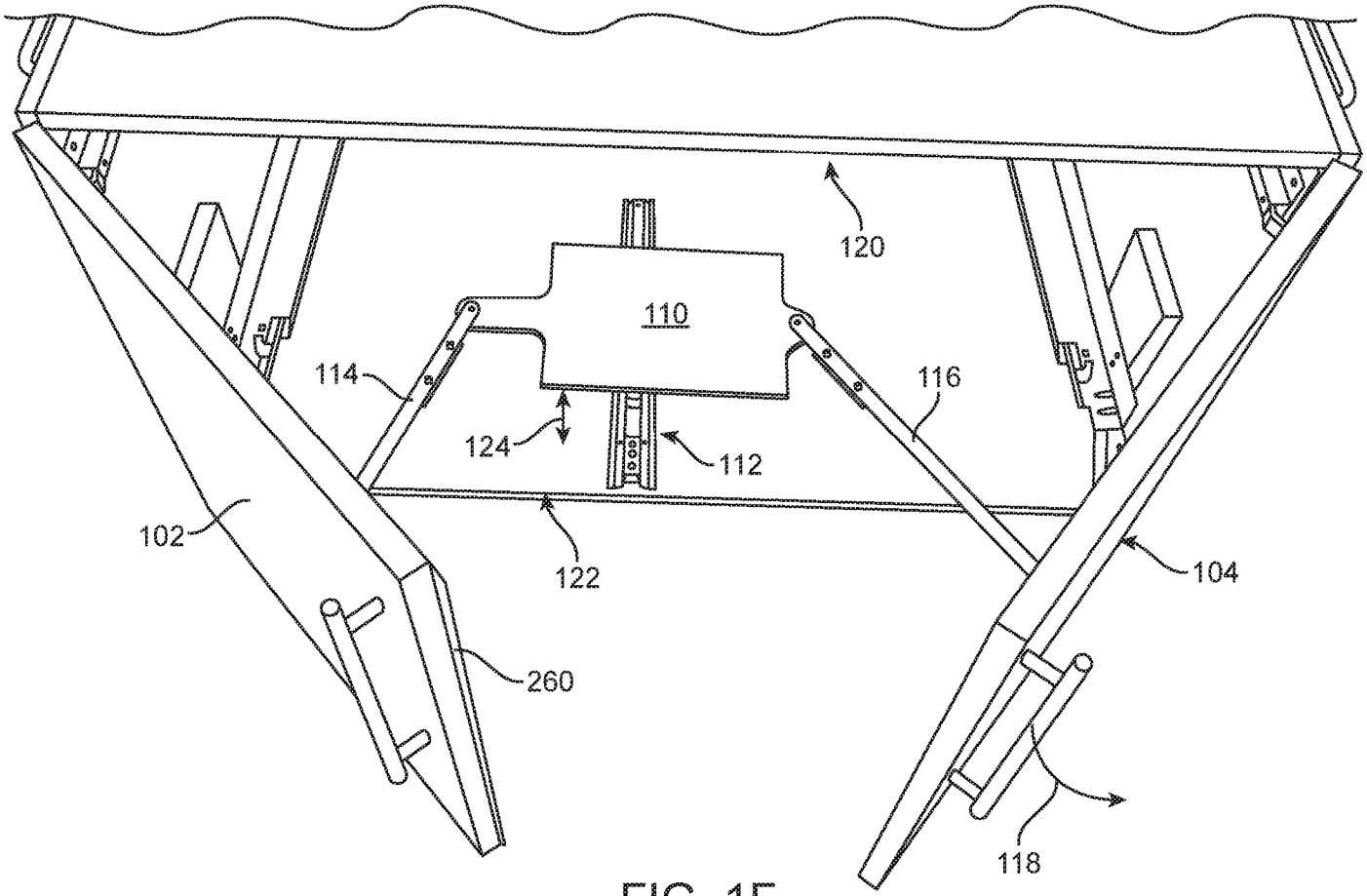
Figure 1G:
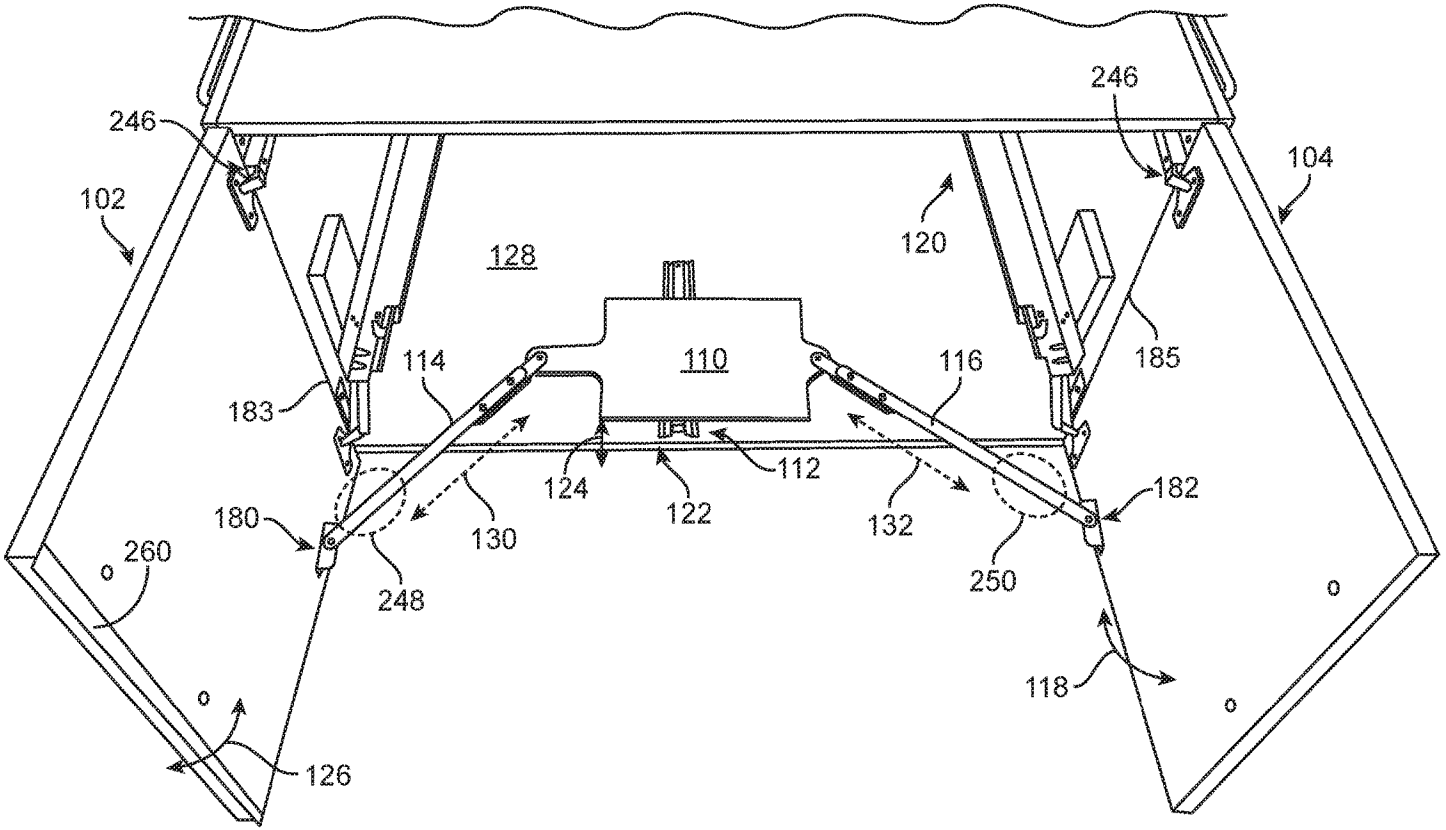
Figure 1H:
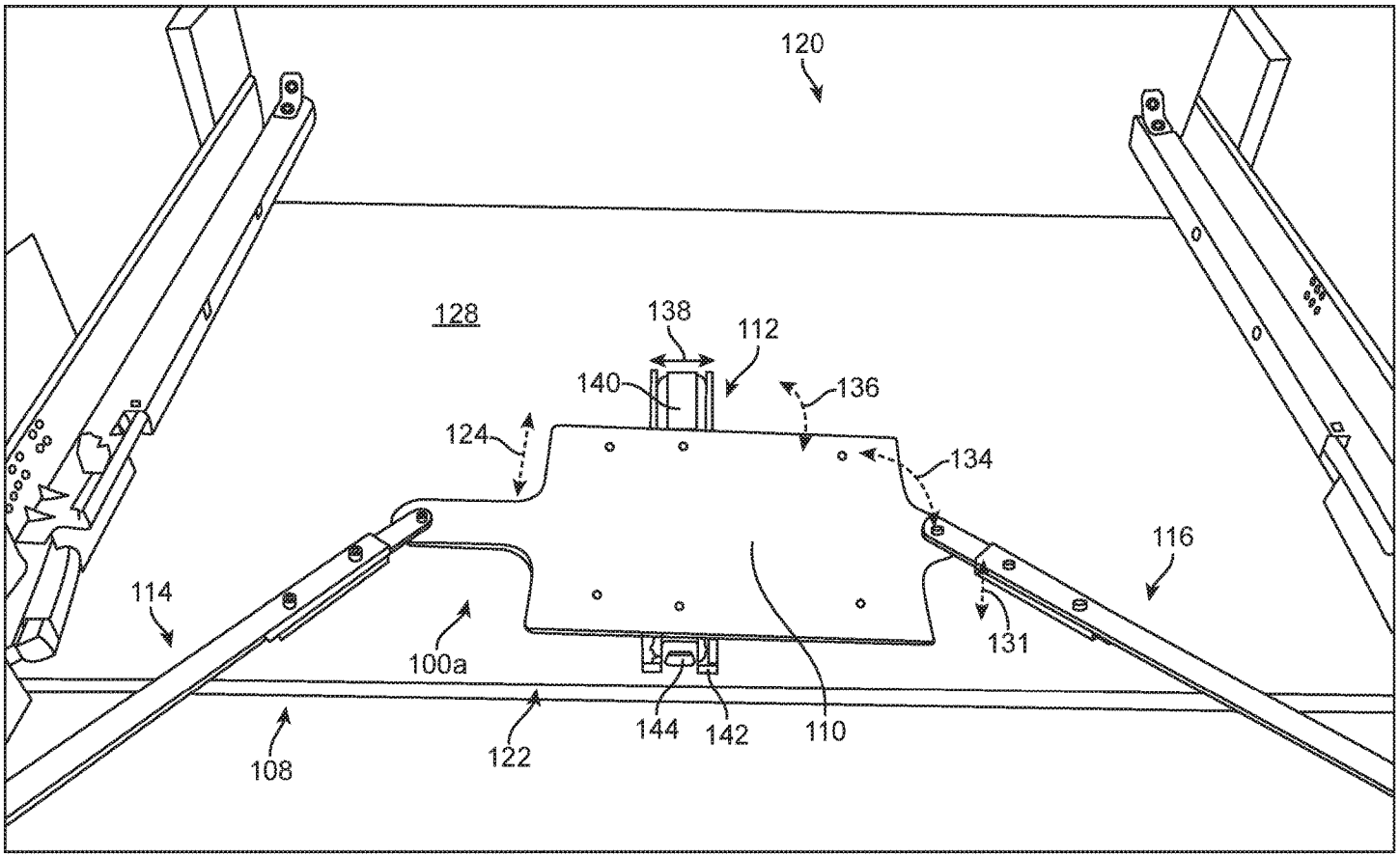

FIGS. 1F to 1H are non-limiting, exemplary illustrations of an exemplary cabinet comprised of an embodiment of a device of the present invention for coordinated control and operation of double doors (from closed to open position), but without the drawer shown in accordance with one or more embodiments of the present invention. In the case of FIGS. 1F to 1H, drawer 106 has been completely removed to clearly show the generally inconspicuous installed device 100*a*.

As further detailed below, device 100*a* includes a plate 110 that is connected with a linear motion facilitator 112, and a set of adjustable links 114 and 116 that connect plate 110 to respective first and second doors 102 and 104. When one of the doors 102 or 104 is pulled to swing to an open position (as shown by arrows 118 or 126), one of the adjustable links 114 or 116 associated with that door 102 or 104 transfers pulling force (a torque) to plate 110 to move it from interior closed-off side 120 of cabinet 108 towards open-side 122 along linear reciprocating path shown by arrow 124.

The motion of plate 110 is rectilinear, facilitated by linear motion facilitator 112. Accordingly, application of a torque (as door 102 or 104 is pulled and rotates at a connection hinge 246) is translated into a linear motion of plate 110 by linear motion facilitator 112.

As plate 110 is pulled in linear direction 124, plate 110 pushes on the other one of the adjustable links 116 or 114. This push on one of the adjustable links 116 or 114 pushes open the other door 102 or 104. In other words, linear force of plate 110 due to its linear motion is translated into a torque to swing open the other door 102 or 104 (in the direction shown by arrow 126 or 118). Therefore, both first and second doors 102 and 104 are enabled to swing open when one of the first or the second door 102 or 104 swings open (with one hand) and are closed when one of the first or the second door 102 or 104 swings closed with one hand.

For closing the doors 102/104, when one of the doors 102 or 104 is pushed to swing closed position (as shown by arrows 118 or 126), one of the adjustable links 114 or 116 associated with that door 102 or 104 transfers pushing force (a torque) to plate 110 to move it from open-side 122 of cabinet 108 towards interior closed-off side 120 in along a linear reciprocating path shown by arrow 124.

The motion of plate 110 is rectilinear, facilitated by linear motion facilitator 112. Accordingly, application of a torque (as door 102 or 104 is pushed to swing close and rotates at a connection hinge 246) is translated into a linear motion of plate 110 by linear motion facilitator 112.

As plate 110 is pushed in linear direction 124, plate 110 pulls on the other one of the adjustable links 116 or 114. This pull on one of the adjustable links 116 or 114 pulls-in or swings closes the other door 102 or 104. In other words, linear force of plate 110 due to its linear motion is translated into a torque to swing close the other door 102 or 104 (in the direction shown by arrow 126 or 118). Therefore, both first and second doors 102 and 104 are enabled to be closed when one of the first or the second door 102 or 104 is closed (swings closed with one hand) and are opened when one of the first or the second door 102 or 104 is opened (swings open) with one hand.

As best illustrated in FIG. 1H and further detailed below, linear motion facilitator 112 is positioned on an interior bottom surface 128 of cabinet 108, with plate 110 secured on top of linear motion facilitator 112. The position of device 100*a* at interior bottom surface 128 of cabinet 108 and underneath the lowest level drawer 106 (shown in FIG. 1E) provides for a generally inconspicuously located device.

Additionally, device 100*a* has low profile (low height) 131 of about less than 1 inch and small (substantially flat) form factor that does not take much vertical space from the storage within which it is installed and operates. Further, as best illustrated in FIGS. 1D and 1G, device 100*a* does not obstruct access to the enclosure or drawers when doors 102 and 104 are at a fully open position. In other words, adjustable links 114 and 116 at sections 248 and 250 are sufficiently close or near to cabinet 108 to enable a user to step in as next to cabinet 108 and access stored items without any inferences from or being obstructed by adjustable links 114 and 116.

Figure 1I:
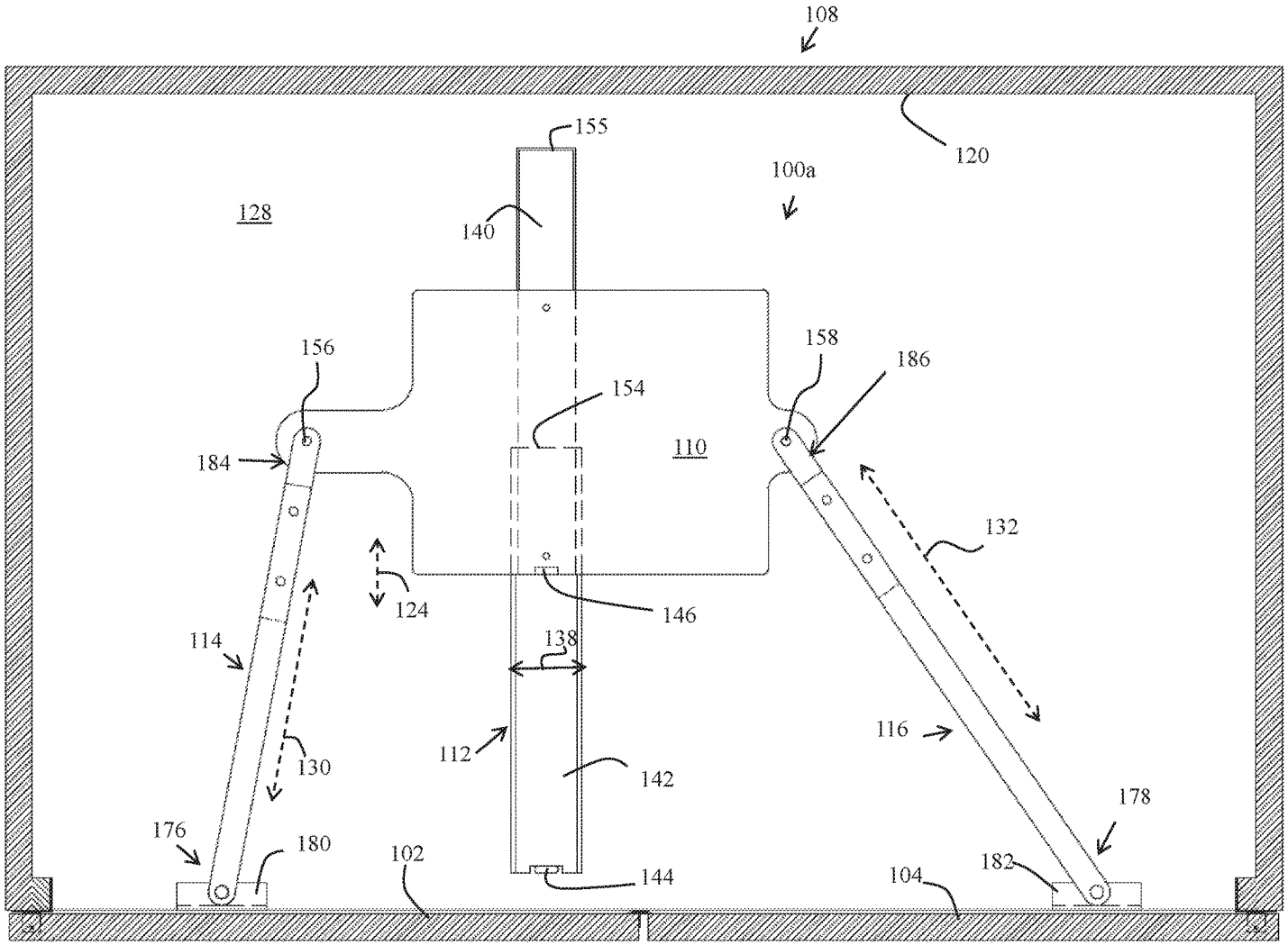
Figure 1J:
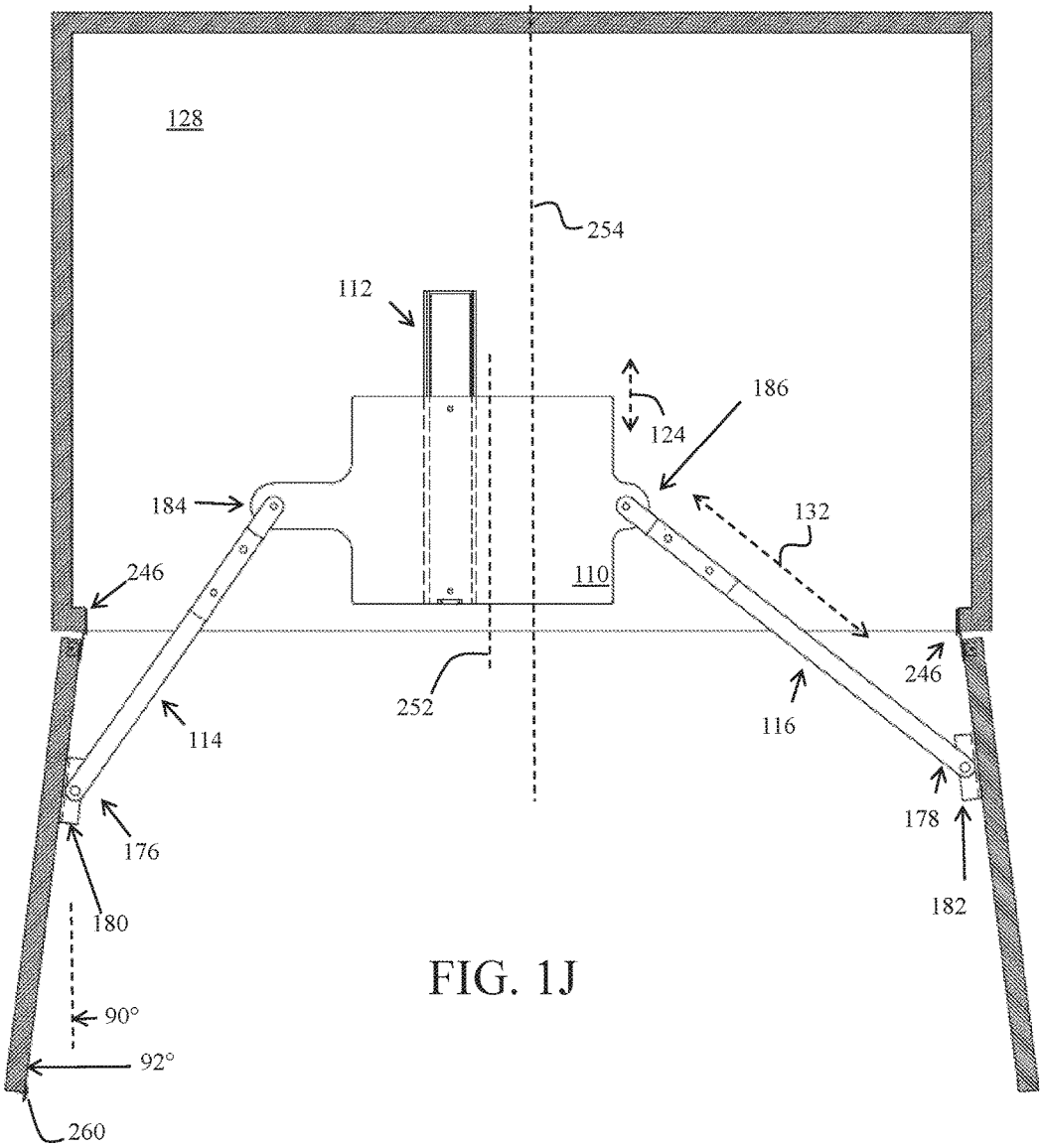

FIG. 1I is a non-limiting, exemplary top view schematic illustration of a sectional plan of a cabinet and an embodiment of a device of the present invention for coordinated control and operation of double doors in accordance with one or more embodiments of the present invention, with doors closed. FIG. 1J is a similar plan view, but showing the doors open.

As illustrated in FIGS. 1A to 1J, device 100*a* for coordinated control and operation of double doors 102 and 104 is comprised of plate 110 with reciprocating rectilinear motion 124. Device 100*a* further includes adjustable links 114 and 116 with adjustable lengths 130 and 132 that connect plate 110 to double doors 102 and 104.

In the non-limiting, exemplary embodiment illustrated in FIGS. 1A to 1J, both first and second doors 102 and 104 swing open when one of the doors (102 or 104) is pulled open and sequentially close when one of the doors (102 or 104) is pushed to close. As further illustrated, plate 110 is connected to linear motion facilitator 112 that enables plate 110 to have reciprocating rectilinear motion 124.

Figures 1, 1K:
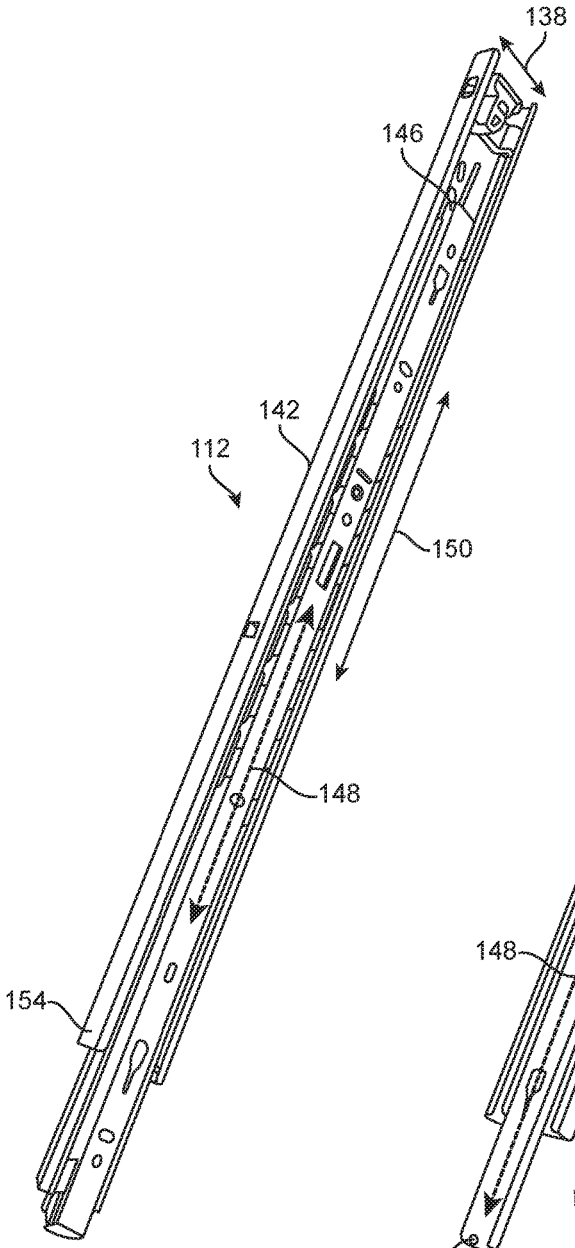
Figures 1, 1K, 2:
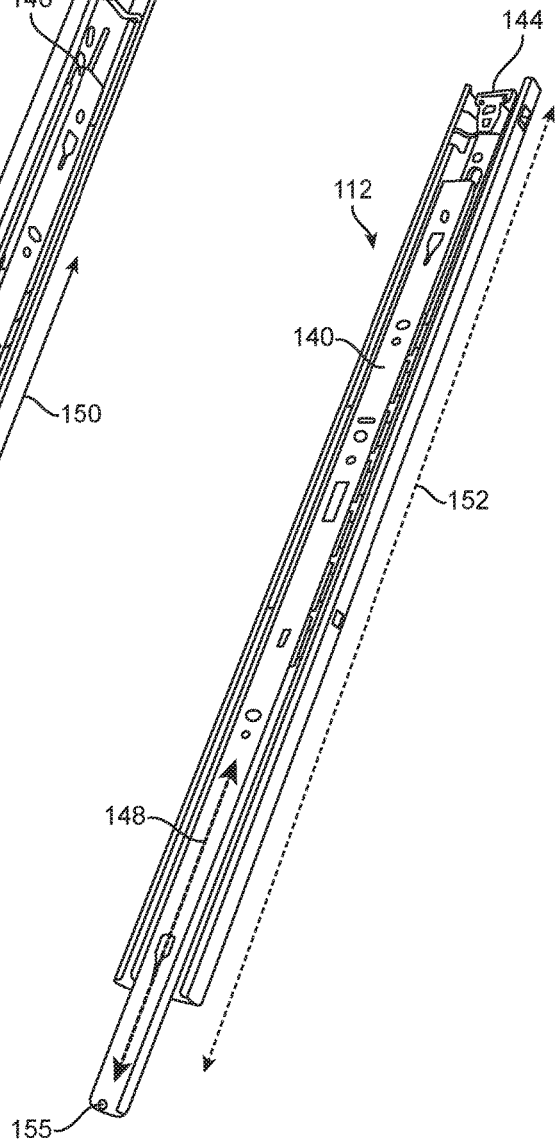
FIGS. 2A to 2C are non-limiting, exemplary illustrations of another embodiment of a device of the present invention for coordinated control and operation of double doors in accordance with one or more embodiments of the present invention.

As illustrated in FIGS. 1A to 1J, a stationary member 142 of linear motion facilitator 112 of device 100*a* is secured to bottom interior surface 128 of cabinet 108 while plate 110 is connected on top of a non-stationary member 140 of linear motion facilitator 112. FIGS. 1K-1 and 1K-2 are non-limiting, exemplary views of linear motion facilitator used in device 100*a* in accordance with one or more embodiments of the present invention.

As illustrated in FIGS. 1A to 1K-2, linear motion facilitator 112 is a slider with sufficient width 138 to prevent out of plane movement of plate 110 shown by arrows 134 and 136 in FIG. 1H. In non-limiting, exemplary instance illustrated in FIGS. 1A to 1K-2, linear motion facilitator 112 is a well known ball bearing full extension slide fixed to interior bottom 128 of cabinet 108 by stationary member 142, while plate 110 is connected to non-stationary (moveable) member 140 of ball bearing full extension slide 112, which enables reciprocating linear motion 124 of plate 110. Non-stationary member 140 moves along a linear reciprocating path shown by arrows 148 in FIGS. 1K-1 and 1K-2, which runs parallel longitudinal axis 150 of linear motion facilitator 112 that, in turn, provides for an overall varying length 152.

Linear motion facilitator 112 is comprised of at least stationary member 142 that is fixed onto cabinet 108 with non-stationary member 140 connected to plate 110. Linear motion facilitator 112 may further include a friction latch-stop 144 at a distal end thereof to maintain doors 102 and 104 at open positions. That is, non-stationary member 140 of linear motion facilitator 112 includes well known latching piece (or flange) 146 that frictionally latches onto latch-stop 144 of linear motion facilitator 112.

It should be noted that linear motion facilitator 112 may comprise of a completely different structure so long as it provides a smooth, steady linear reciprocating motion for plate 110. Non-limiting examples of such structures (other types of linear motion facilitators 112) may include, for example, using rollers or Teflon guides that ride on rails/tracks, etc. that may carry plate 110 along a rectilinear reciprocating path.

During operation, non-stationary member 140 moving along linear reciprocating path 148 may pass distal end 154 of stationary member 142 and hence, providing an overall varying length 152. Since the overall length 152 of linear motion facilitator 112 varies during operation, linear motion facilitator 112 must be positioned so that distal edge (non-latching end) 155 of non-stationary member 140 does not hit against interior cabinet wall (closed off-side) 120. In other words, at a minimum, appropriate overall length and fixing position with respect to a location at interior bottom surface 128 must be selected to provide non-stationary member 140 sufficient space to travel any length necessary to full close doors or open them to an appropriate angle (preferably greater than 90°).

As indicated above, other different types of linear motion facilitator 112 may be used with a different structure where for example, a non-stationary or moving member never moves or extends out of the stationary member (such as a set of rollers that ride on a track). In such instances, the length of the track and in particular, the amount of travel of the rollers must be of sufficient distance to enable full operation of the doors.

As illustrated in FIGS. 1A to 1L, and FIG. 1L in particular, plate 110 is comprised of a first and a second pivot openings 156 and 158 that are connected to adjustable links 114 and 116. Plate 110 further includes two or more connection openings 160 for connection of plate 110 with linear motion facilitator 112.

First and second pivot openings 156 and 158 are positioned at respective first and second flanges 162 and 164 that extend from sides 166 and 168 of plate 110 at unequal first and second lengths 170 and 172 to provide for asymmetric actuation of first and second doors 102 and 104. This way, both first and second doors 102 and 104 are sequentially opened when one of the first or the second door (102 or 104) is opened and are closed sequentially when one of first or second door (102 or 104) is closed.

As best illustrated in FIGS. 1F to 1J, center-line 252 of rectangular portion of plate 110 is asymmetrically positioned in relation to linear motion facilitator 112 and also in relation to cabinet 108 center 254 (and hence in relation to first and second door 102 and 104) for asymmetric actuation of doors 102 and 104. In this non-limiting, exemplary instance, length 130 of adjustable link 114 is shorter than length 132 of adjustable link 116, causing sequential operation of doors 102 and 104 where door 102 closes before door 104, but opens after door 104 opens.

It should be noted that the location of door brackets 180 and 182 from edges 183 and 185 (best illustrated in FIG. 1G) of doors 102 and 104 are also different. Bracket 180 location for door 102 that closes first is further (e.g., about 1 inch further) from edge 183 compared with location of bracket 182 for door 104 from edge 185.

As illustrated, plate 110 and linear motion facilitator 112 are asymmetrically positioned in relation to the first and the second doors 102 and 104 for asymmetric actuation of the first and the second doors 102 and 104. Accordingly, linear motion facilitator 112, plate 110, and first and second pivot openings 156 and 158 are asymmetrically position with respect to each other and that of the cabinet interior and doors 102 and 104, all to appropriately facilitate sequential actuation of doors 102 and 104.

Figure 1L:
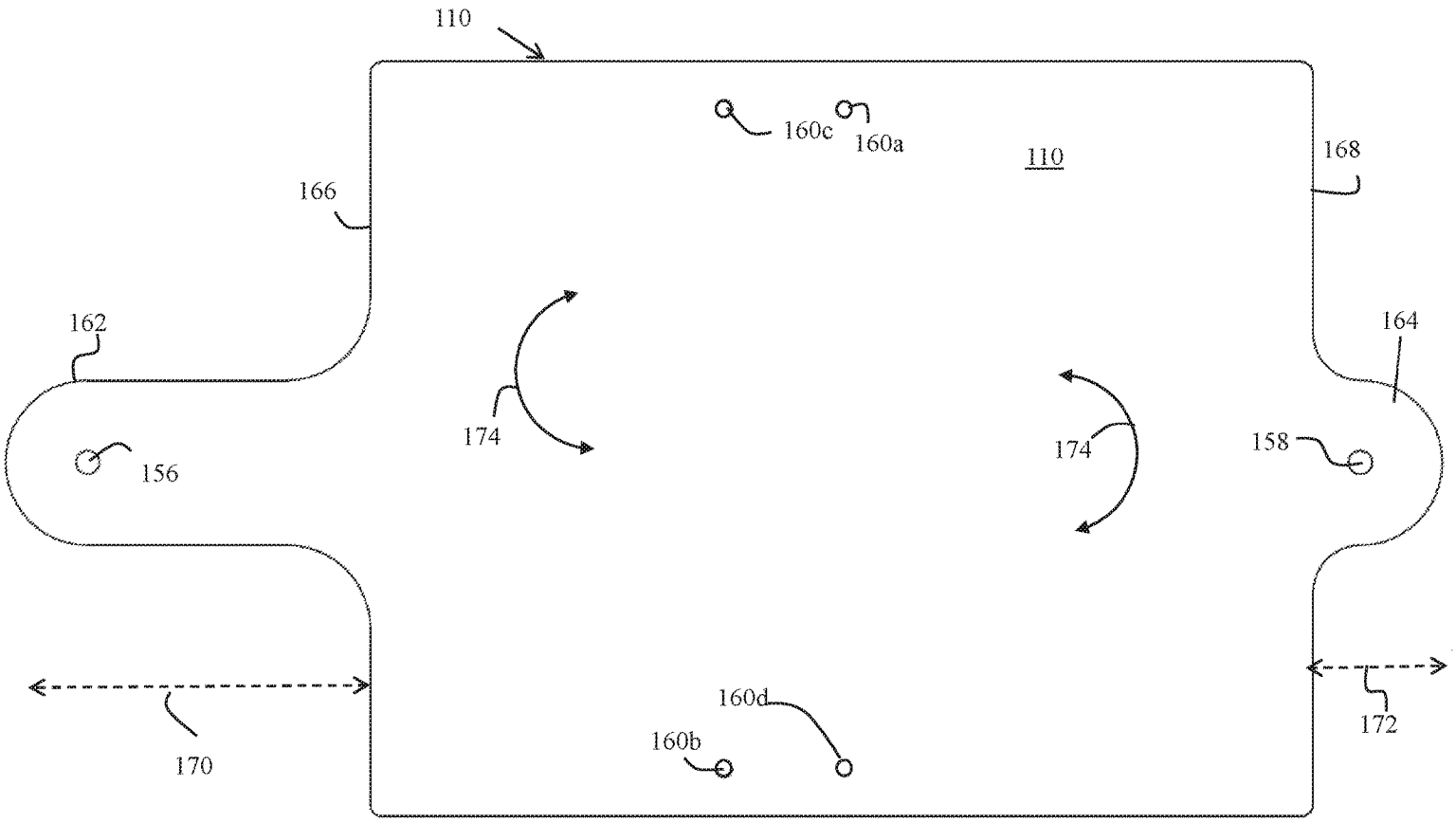
Figure 1M:
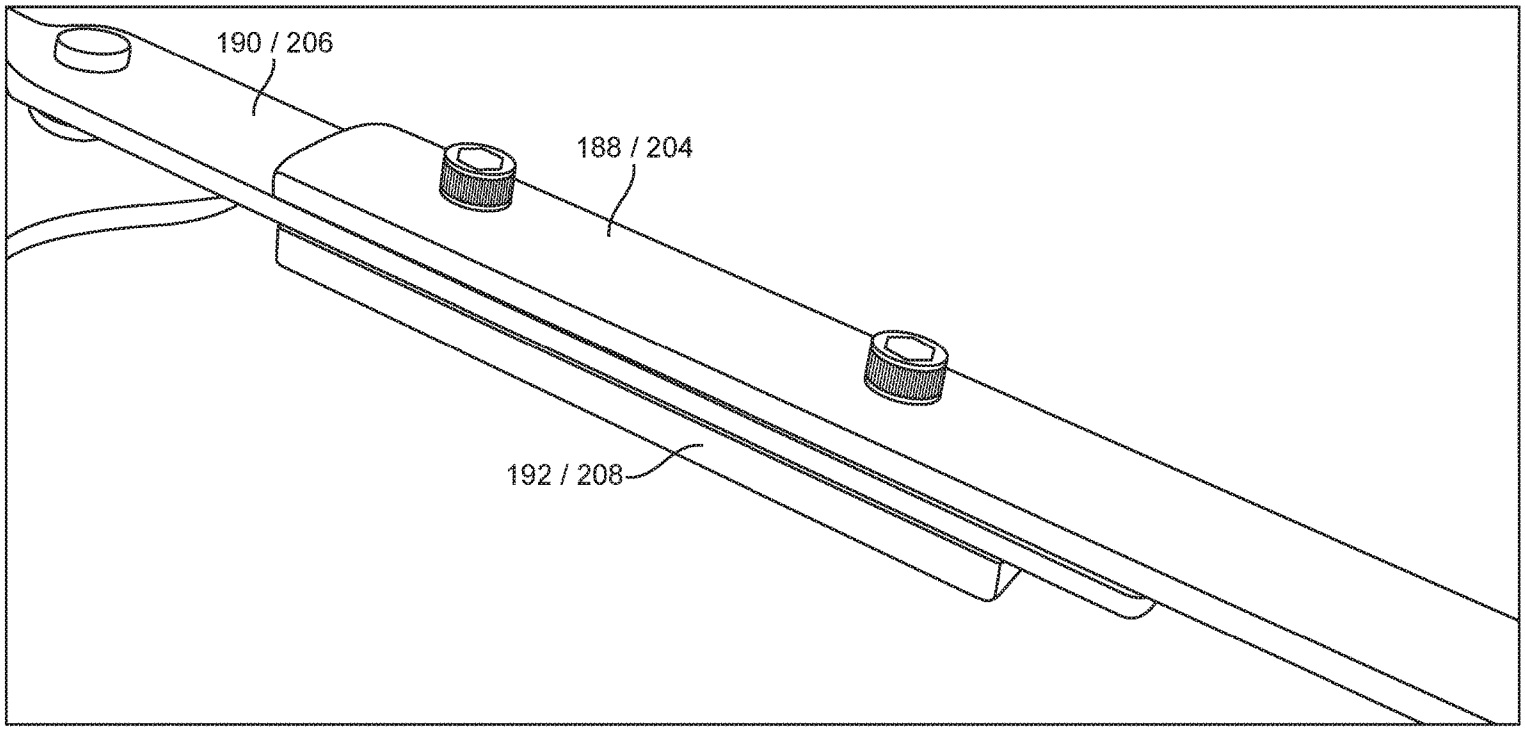

As illustrated in FIG. 1L, preferably, connection openings 160 that are diagonal may be used for connection of plate 110 with linear motion facilitator 112. Diagonally opposite connection openings 160 prevent in-plane 174 and out of plane 134 and 136 (FIG. 1H) motion of plate 110 while enabling transfer of force from one adjustable link 114 or 116 to another for actuation of doors 102 and 104.

Diagonally opposite connection openings 160 (e.g., 160*a* and 160*b*, if only two are used) counter torque experienced by plate 110 at first and second pivot points 156 and 158, and translate the torque into a linear motion 124 of plate 110. As illustrated in FIGS. 1A to 1J, non-diagonal connection openings (e.g., 160*c* and 160*b*) may also be used instead of diagonally opposite connection openings (e.g., 160*c* and 160*d*).

It should be noted that plate 110 must have a shape with sufficient size (dimensions) to minimize the overall span of adjustable lengths 130 and 132 of adjustable links 114 and 116 while still enabling for smooth actuation of doors 102 and 104 (sequential or otherwise). The shorter the lengths 130 and 132 of adjustable links 114 and 116 are the more stable the overall system.

If lengths 130 and 132 of adjustable links 114 and 116 are too long to accommodate a certain configuration and size of plate 110, they may flex and hence, a more costly, rigid design must be required for links 114 and 116 for that specific design shape of the plate. Accordingly, adjustable links 114 and 116 must be of shortest length possible for stability, while having sufficient length for proper operation of doors 102 and 104 (e.g., open to greater than 90°), including proper sequencing for proper sequential operation (actuation) of doors 102 and 104 (if need be).

As illustrated in FIGS. 1A to 1R-6, and FIG. 1M to 1R-6 in particular, adjustable links 114 and 116 connect plate 110 to respective first door 102 and second door 104. Adjustability of adjustable links 114 and 116 enable use of the same device parts with the same sizes on different sized cabinets with different depths, different door sizes, etc. Additionally, adjustability of the links 114 and 116 also facilitates in sequence operation of doors, if needed.

First ends 176 and 178 of adjustable links 114 and 116 are connected to respective first and second doors 102 and 104 by brackets 180 and 182 (detailed in FIGS. 1R-1 to 1R-6). Second ends 184 and 186 of adjustable links 114 and 116 are connected to first and second pivot openings 156 and 158 of plate 110 (detailed in FIGS. 1N-1 to 1Q-2).

Figures 1, 1N, 1O, 1P:
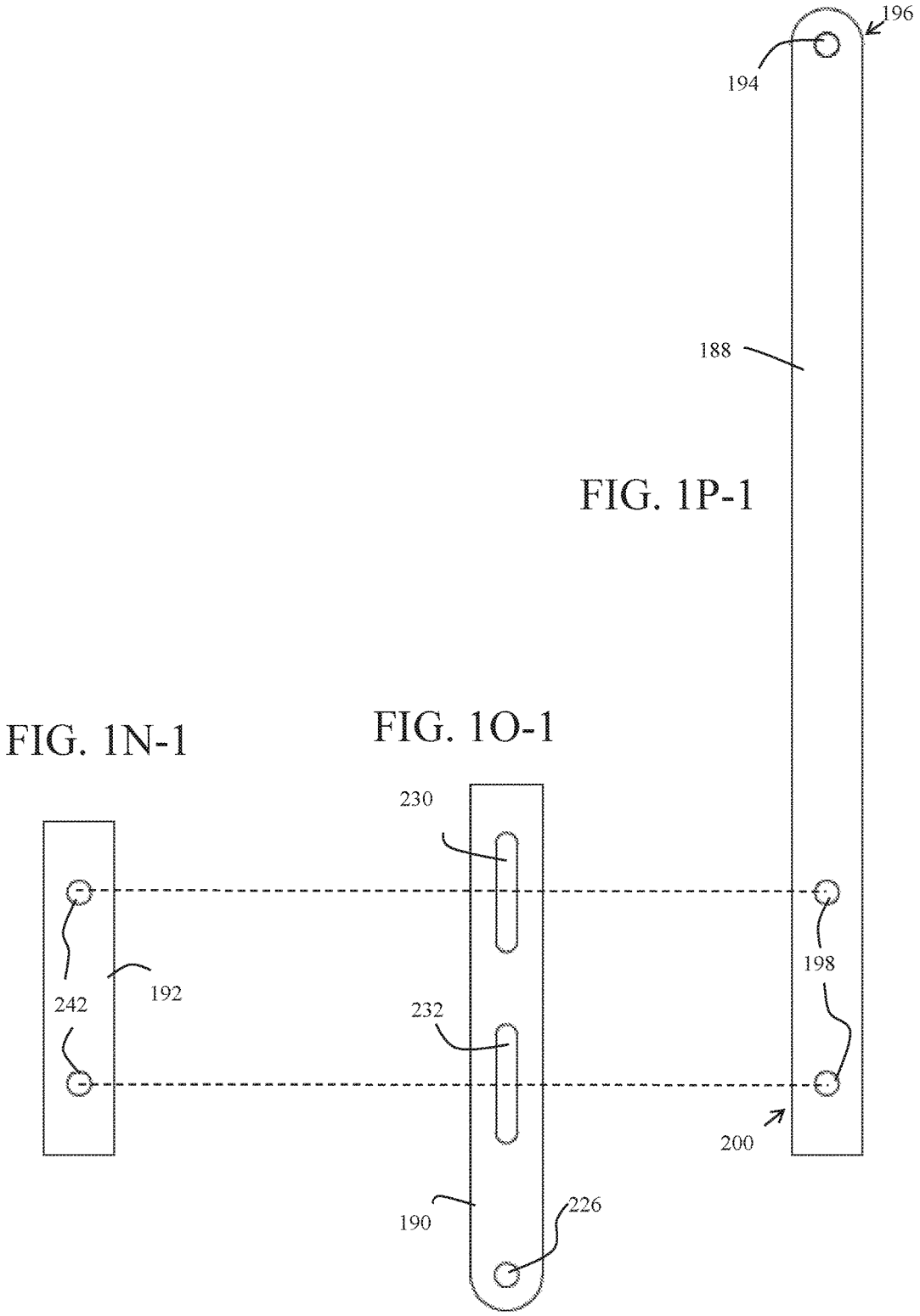
Figures 1, 1N, 1O, 1P, 2:
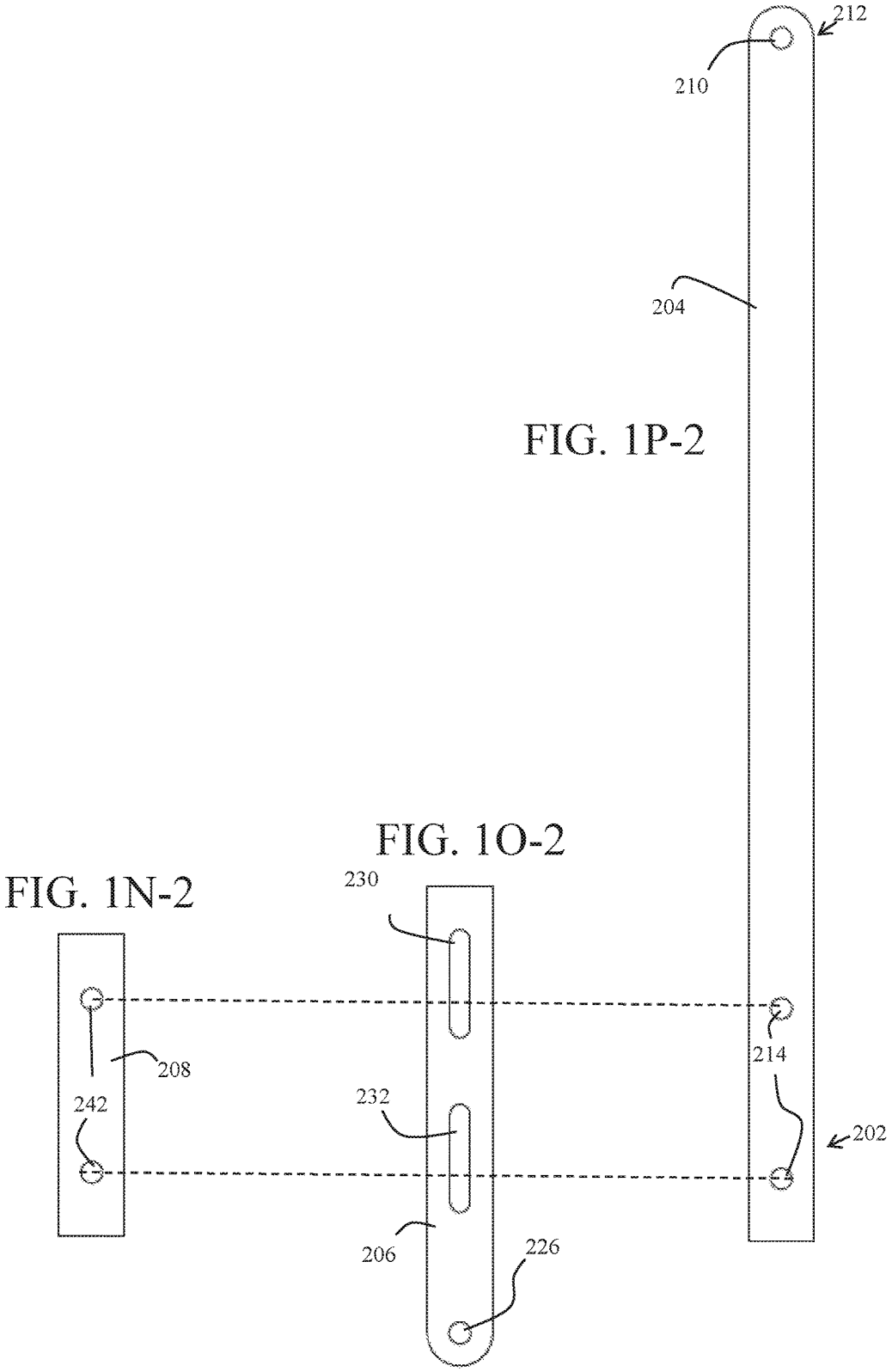

FIGS. 1N-1 to 1P-1 are non-limiting, exemplary illustrations of adjustable link assembly 114 and FIGS. 1N-2 to 1P-2 are non-limiting, exemplary illustrations of adjustable link assembly 116 in accordance with one or more embodiments of the present invention. As best illustrated in FIGS. 1M to 1P-2, adjustable links 114 and 116 are comprised of first members 188 and 204, second members 190 and 206, and connecting members 192 and 208 that connect first and second members (188 with 190, and 204 with 206). As illustrated and detailed below, both links 114 and 116 are identical with the exception of the lengths of their respective first members 188 and 204, which may also be identical. For example, if sequential opening of doors is still desired while using identical first members 188 and 204 for adjustable links 114 and 116, identical (but longer) second members 204 and 206 may instead be used with longer adjuster openings 230/232 to provide sufficient adjustability to enable sequential operations of the doors.

First members 188 and 204 of both links 114 and 116 are elongated pieces that includes first distal end openings 194 and 210 at first ends 196 and 212 for connection with first and second door 102 and 104, and openings 198 and 214 at second ends 200 and 202 for connection with second members 190 and 206. As indicated above, in this non-limiting, exemplary instance, first member 188 of adjustable link 114 (e.g., FIGS. 1P-1) is shorter in length than first member 204 of adjustable link 116 (e.g., FIG. 1P-2) for appropriate sequential actuation of doors.

As best shown in FIGS. 1R-1 to 1R-6, first distal end openings 194 and 210 of first members 188 and 204 are connected to respective brackets 180 and 182 of doors 102 and 104 by pivot pins 216 to enable rotational motion of doors 102 and 104 while accommodating for movement of adjustable links 114 and 116.

As best shown in FIG. 1R-6, first end openings 194 and 210 are aligned with bracket openings 218, which receive bushings 220 through which clevis pins 216 may be inserted and secured in position by flat (annular) washers 222 and keepers 224. First distal ends 196 and 212 of first members 188 and 204 are generally rounded, functioning as relief against the flat interior surface of doors 102 and 104 so that they do not contact the interior surface of door 102 and 104. Brackets 180 and 182 are well known, and also include connection openings 244 for securing the brackets 180 and 182 onto interior surfaces of first and second doors 102 and 104 by fasteners 256.

Figures 1, 1Q:
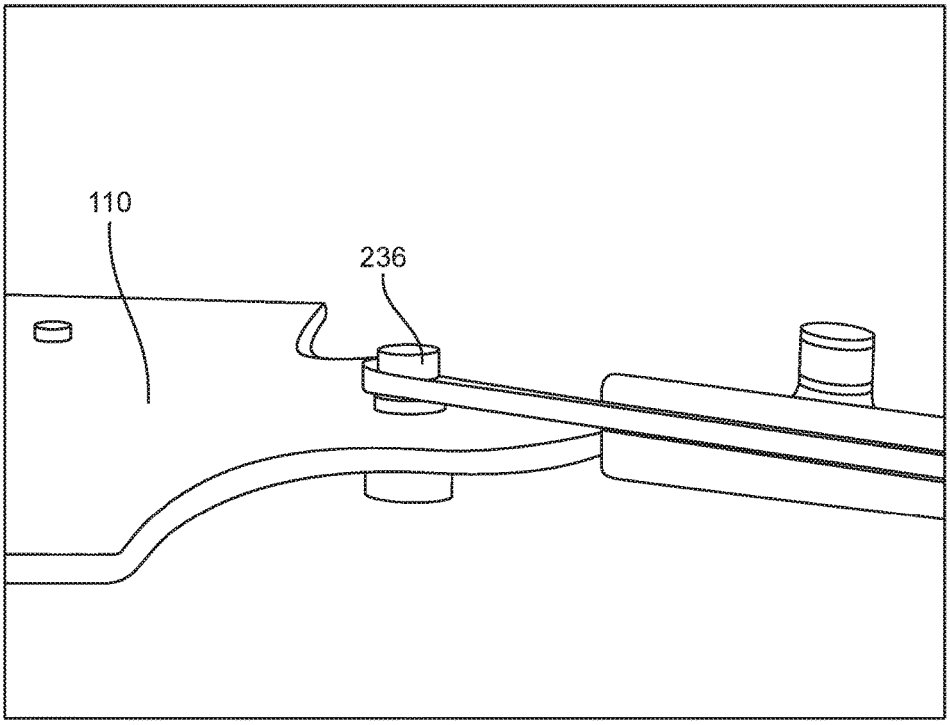
Figures 1, 1Q, 2:
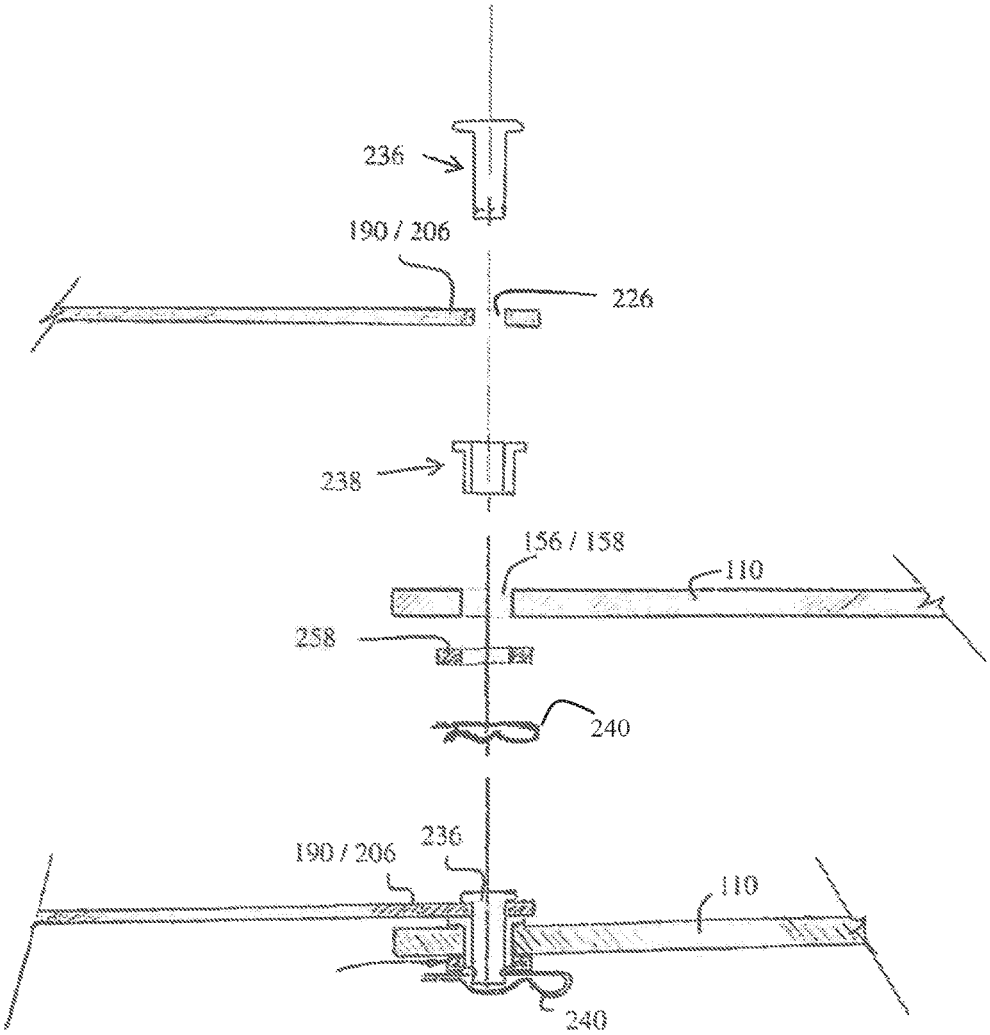

Second members 190 and 206 of adjustable links 114 and 116 are identical and include second distal end opening 226 for connection with plate 110, and adjuster openings 230 and 232 for connection with first members 188 and 204. As best illustrated in FIG. 1Q-2, second distal end openings 226 of second members 190 and 206 are aligned with connection pivot opening 156 and 158, which receive bushings 238 through which clevis pins 236 may be inserted and secured in position by flat (annular) washers 258 (e.g., a polyurethane washer) and keepers 240 (e.g., a hair pin keeper).

Adjuster openings 230 and 232 of second members 190 and 206 enable varying longitudinal axis of each link assembly 114 and 116 to a desired lengths 130 and 132 to accommodate for sequential opening and closing of doors 102 and 104. Further, adjuster opening 230 and 232 of second members 190 and 206 allows for manufacturing and installation tolerances for variations in cabinet, doors 102 or 104, and plate 110. Adjuster opening of second members 190 and 206 are elongated slots, which enable varying the overall length 130 and 132 of adjustable links 114 and 116.

Connecting members 192 and 208 are identical and include at least one connector opening 242 that is aligned with opening 198 and 214 of first member 188 and 204 and adjuster opening 230 and 232 of second member 190 and 206 to secure first and second members 188/190 and 204/206 by a coupler. A fastener through openings 198/214 of the first members 188/204, the adjuster opening 230 and 232 of second members 190/206, and connector openings 242 of connector member 192/208 mechanically secures first member 188/204 to second member 190/206. Lengths 130 and 132 of adjustable links 114 and 116 must be of sufficient span so to enable doors 102 or 104 to open passed 90° to clear the drawers being pulled.

Figures 1, 1R:
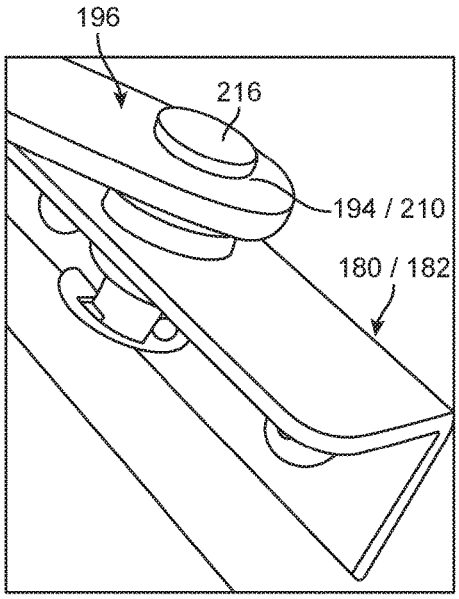
Figures 1, 1R, 2:
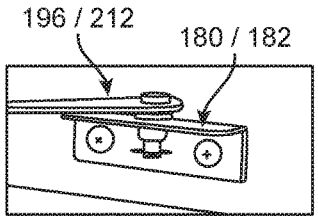
Figures 1, 1R, 2, 3:
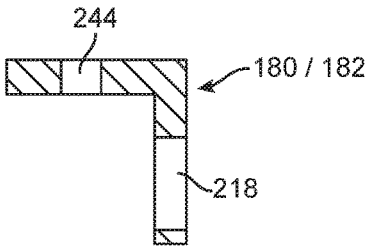
Figures 1, 1R, 2, 3, 4:
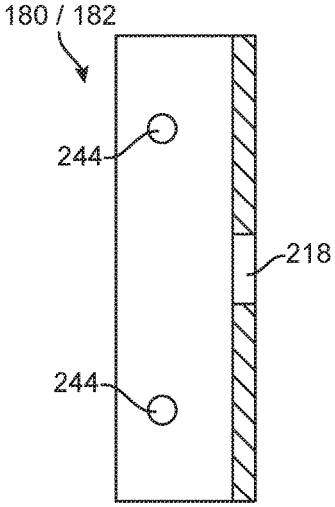
Figures 1, 1R, 2, 3, 4, 5:
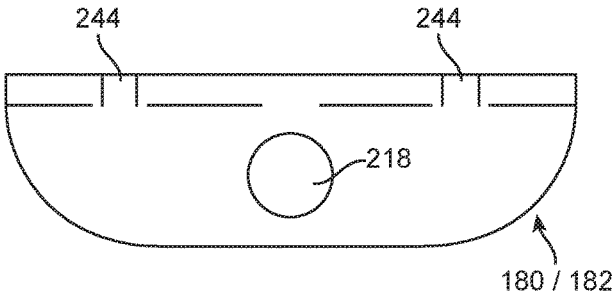
Figures 1, 1R, 2, 3, 4, 5, 6:
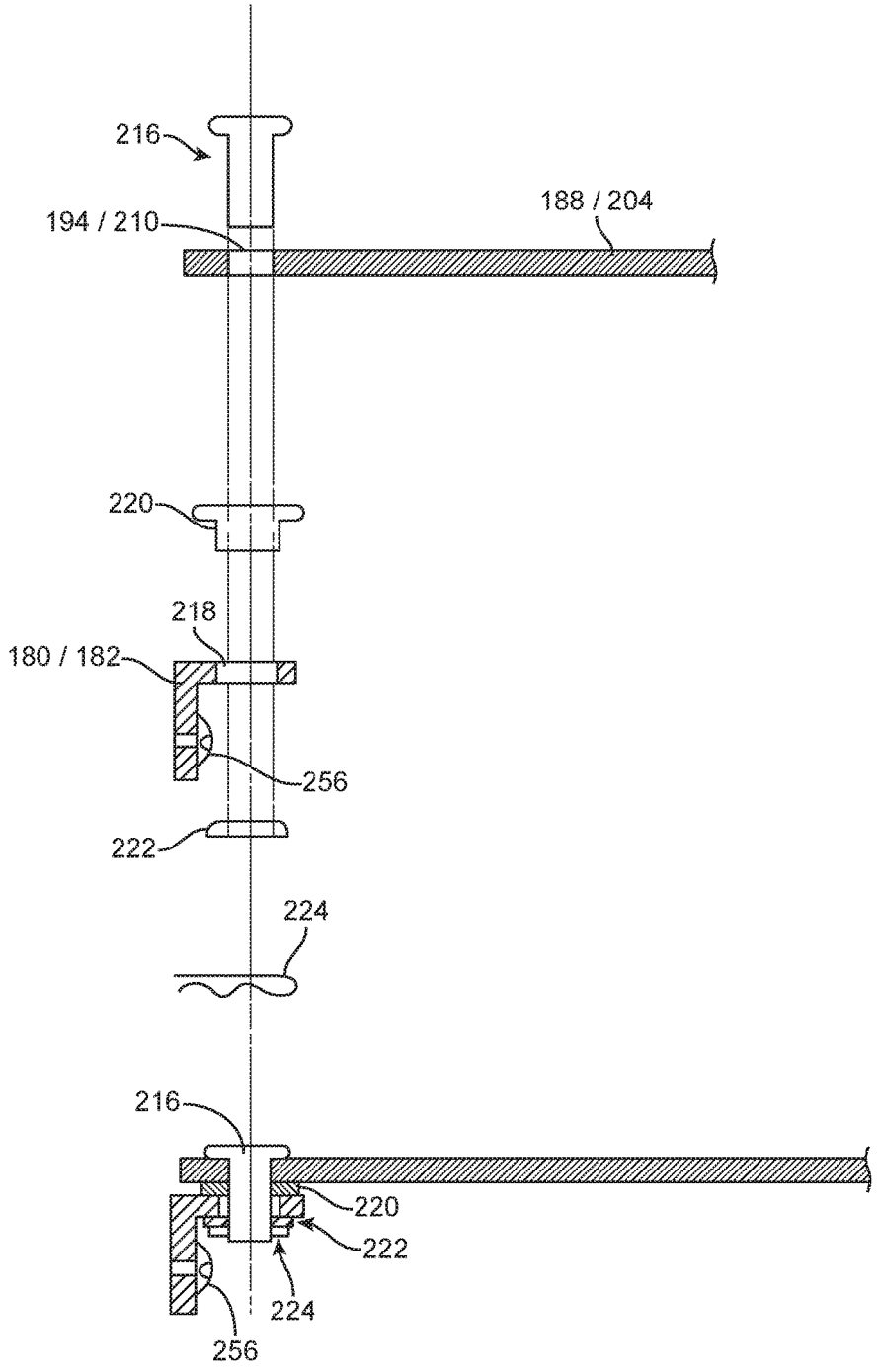
Figure 2A:
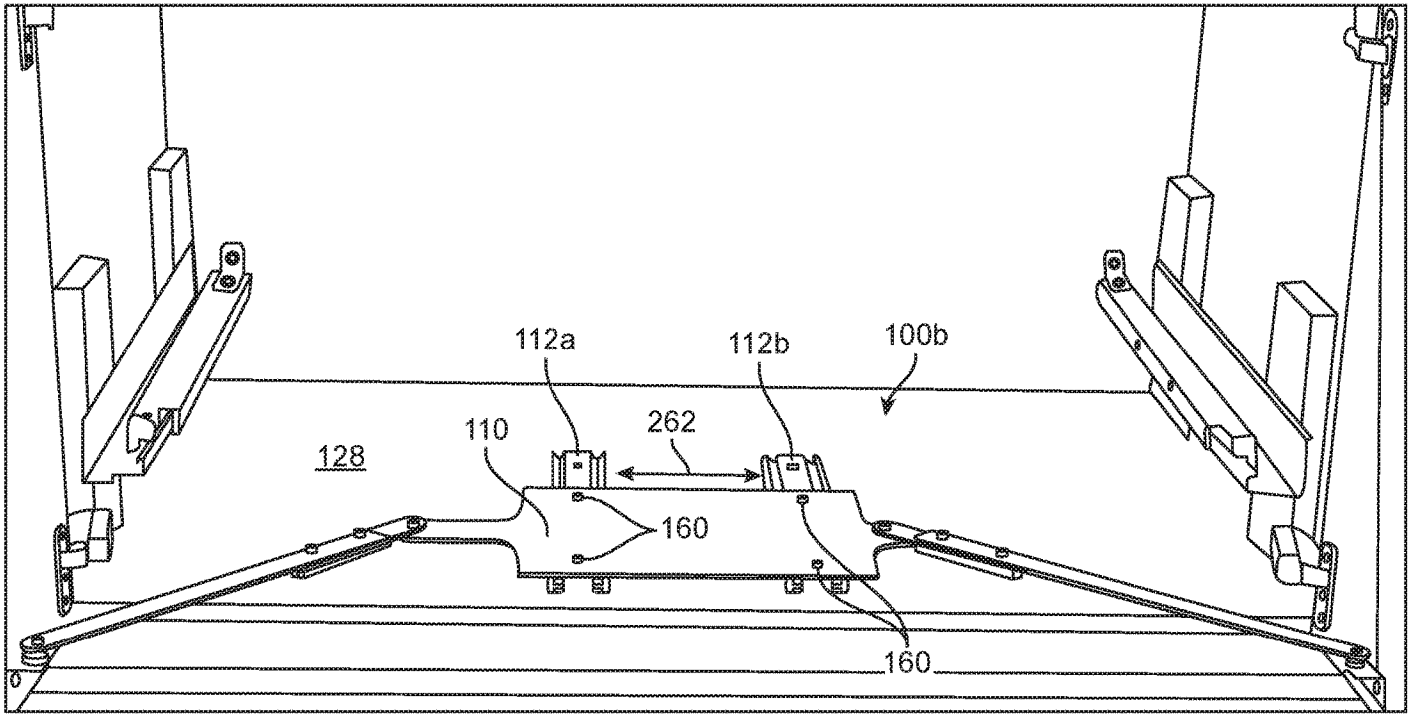
Figure 2B:
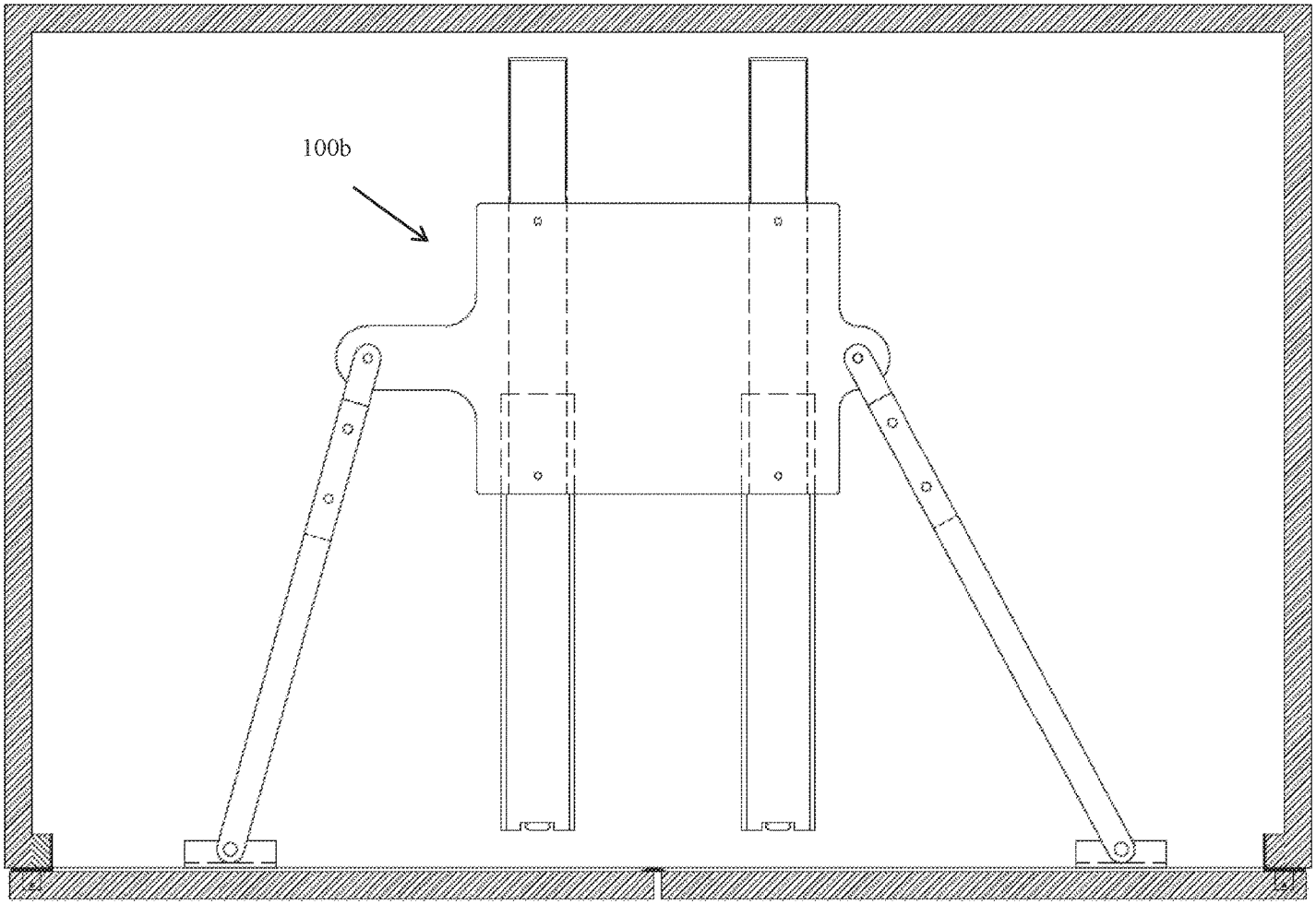
Figure 2C:
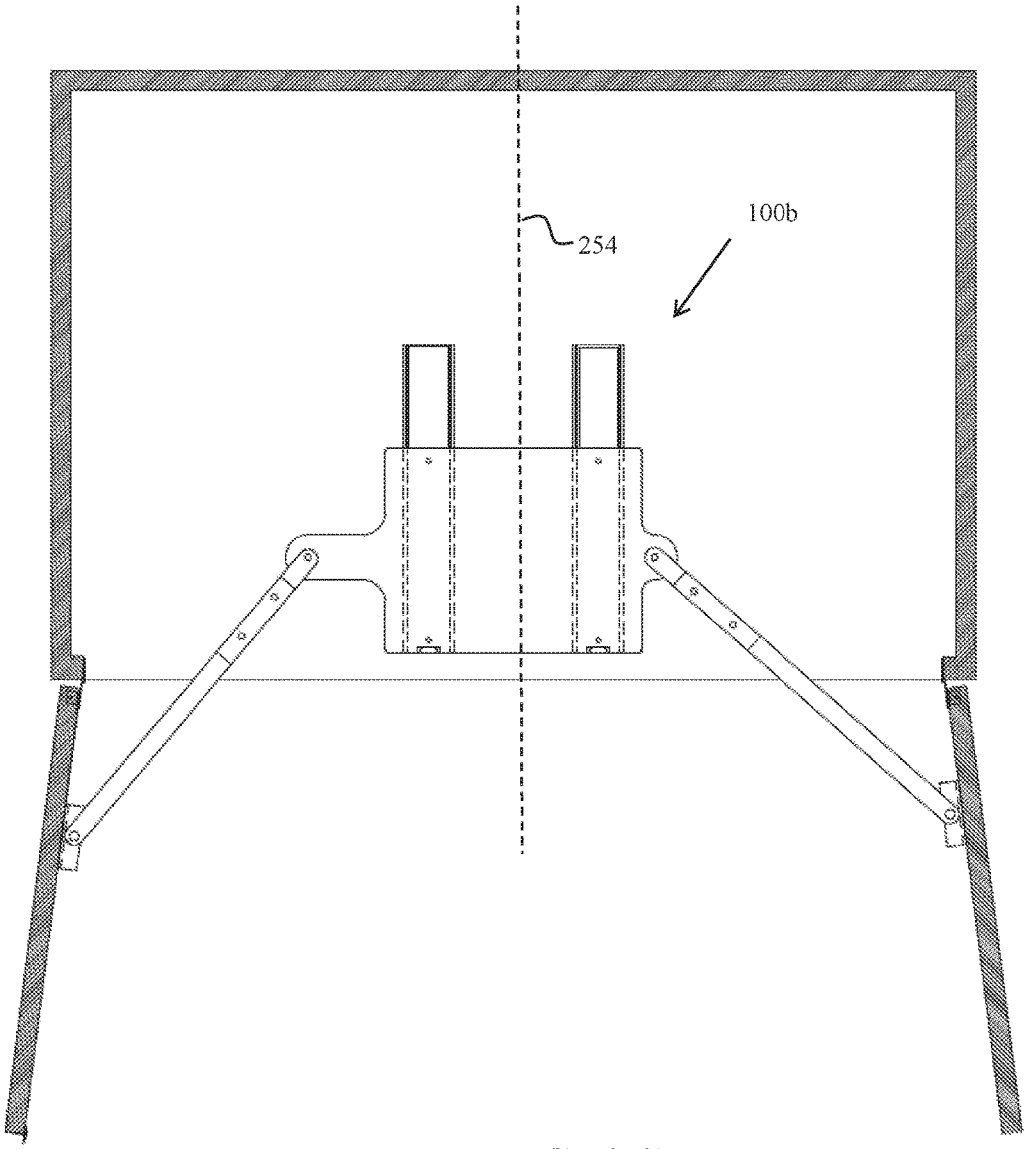

FIGS. 2A to 2C are non-limiting, exemplary illustrations another embodiment of a device of the present invention for coordinated control and operation of double doors in accordance with one or more embodiments of the present invention. The device 100*b* illustrated in FIGS. 2A to 2C includes similar corresponding or equivalent components, interconnections, functional, operational, and or cooperative relationships as the device 100*a* that is shown in FIGS. 1A to 1R-6, and described above. Therefore, for the sake of brevity, clarity, convenience, and to avoid duplication, the general description of FIGS. 2A to 2C will not repeat every corresponding or equivalent component, interconnections, functional, operational, and or cooperative relationships that has already been described above in relation to device 100*a* that is shown in FIGS. 1A to 1R-6 but instead, are incorporated by reference herein.

As illustrated in FIGS. 2A to 2C, in this non-limiting, exemplary instance, device 100*b* uses two linear motion facilitators 112*a* and 112*b*, which is preferred, instead of using a single linear motion facilitator 112 used for device 100*a* shown in FIGS. 1A to 1R-6. Linear motion facilitators 112*a* and 112*b* are positioned parallel at a sufficient distance 262 to provide a wider base-support to thereby assuredly prevent out of plane movement of plate 110 during operations. Use of two parallel linear motion facilitators 112*a* and 112*b* is preferred as they would prevent both out of plane and in plane movement of the plate. The diagonal connecting fasteners will prevent in-plane rotation (twisting) while the use of two sliders prevent output of plane (wobbling) of the plate.

In this non-limiting, exemplary instance, additional connection openings 160 may be provided for connection of plate 110 with both linear motion facilitator 112*a* and 112*b*. In the non-limiting, exemplary instance shown in FIGS. 2A to 2C, four connection openings 160 are used to secure plate 110 to linear motion facilitator 112*a* and 112*b*.

A rectangular portion of plate 110 is symmetrically secured onto linear motion facilitator 112*a* and 112*b*, while non-equally extending flanges 162 and 164 provide the asymmetrical geometry needed for sequence closure of the doors. It should be noted that the combination of plate 110 and linear motion facilitators 112*a* and 112*b* may also be secured asymmetrically or symmetrically in relation to interior of cabinet 108, depending on a variety of factors such as to further facilitate sequential opening, or provide coordinated non-sequential opening, etc.

Figure 3A:
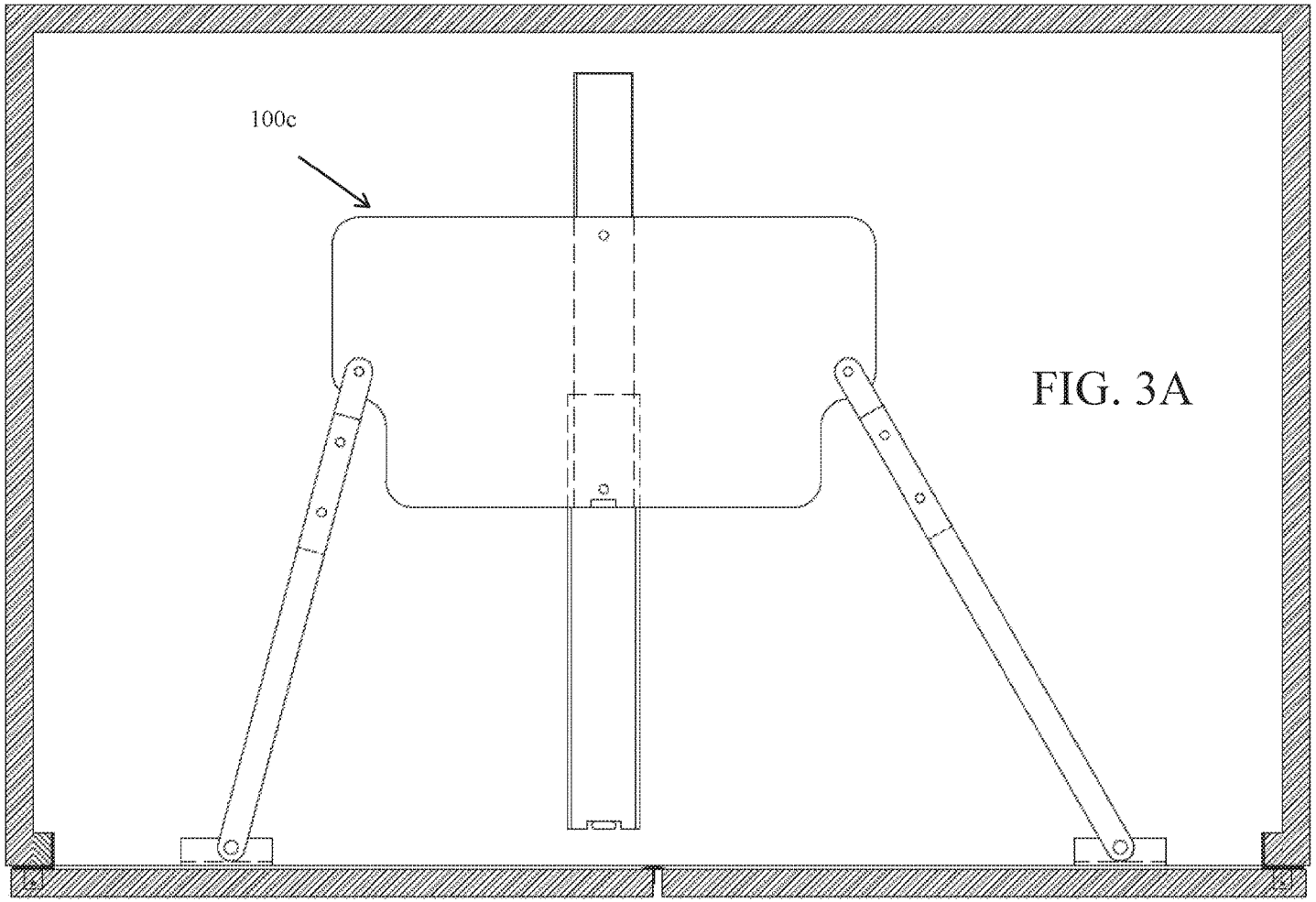
FIGS. 3A and 3B are non-limiting, exemplary illustrations of another embodiment of a device of the present invention for coordinated control and operation of double doors in accordance with one or more embodiments of the present invention.
Figure 3B:
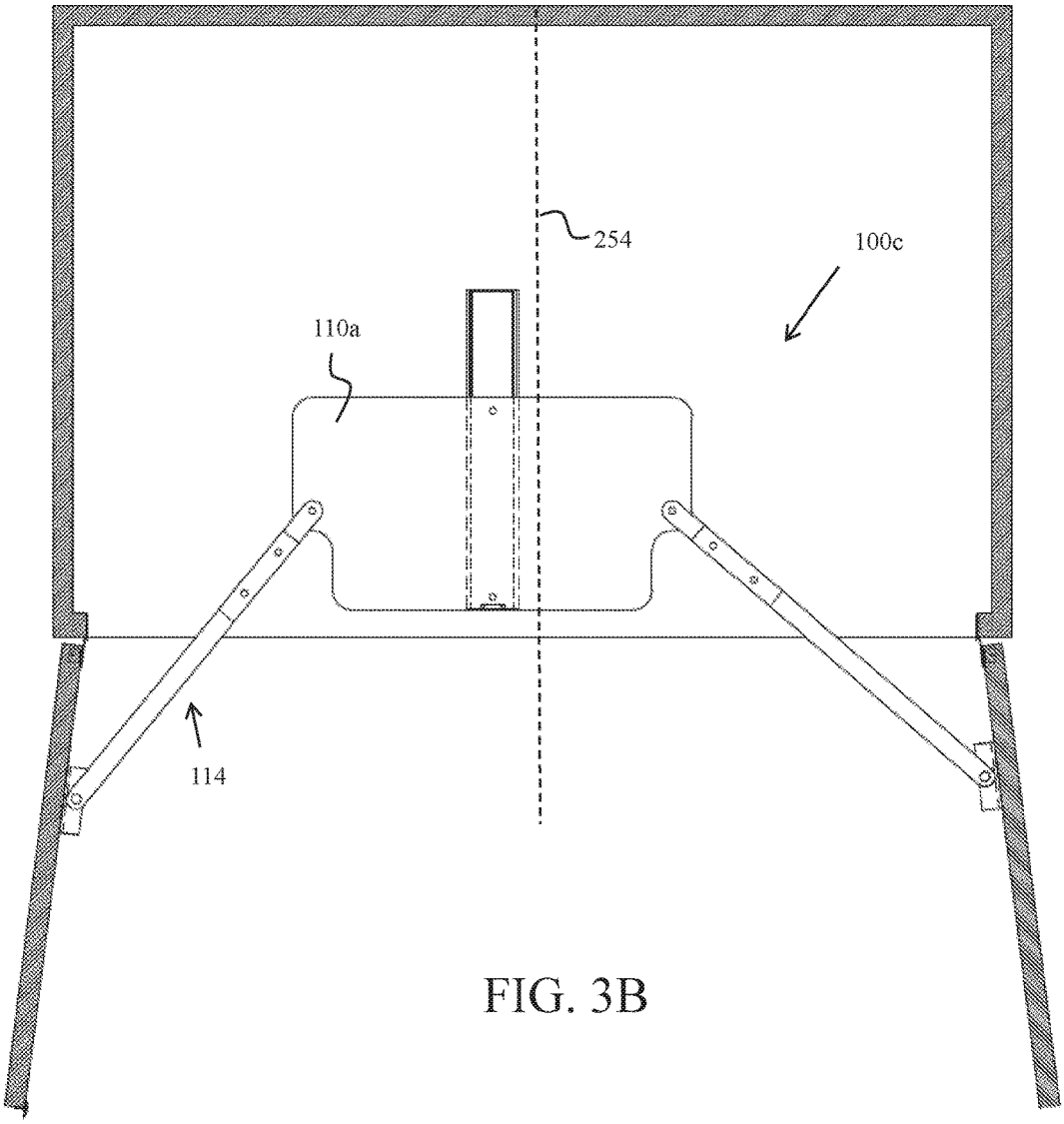

FIGS. 3A and 3B are non-limiting, exemplary illustrations another embodiment of a device of the present invention for coordinated control and operation of double doors in accordance with one or more embodiments of the present invention. The device 100*c* illustrated in FIGS. 3A and 3B includes similar corresponding or equivalent components, interconnections, functional, operational, and or cooperative relationships as devices 100*a* and 100*b* that are shown in FIGS. 1A to 2C, and described above. Therefore, for the sake of brevity, clarity, convenience, and to avoid duplication, the general description of FIGS. 3A and 3B will not repeat every corresponding or equivalent component, interconnections, functional, operational, and or cooperative relationships that has already been described above in relation to devices 100*a* and 100*b* that are shown in FIGS. 1A to 2C but instead, are incorporated by reference herein.

In this non-limiting, exemplary instance, device 100*c* uses a symmetrical plate 110*a* that is symmetrically associated with a single linear facilitator 112, the combination of which are asymmetrically associated with cabinet 108 as shown by cabinet 108 center 254 (FIG. 3B).

Figure 4A:
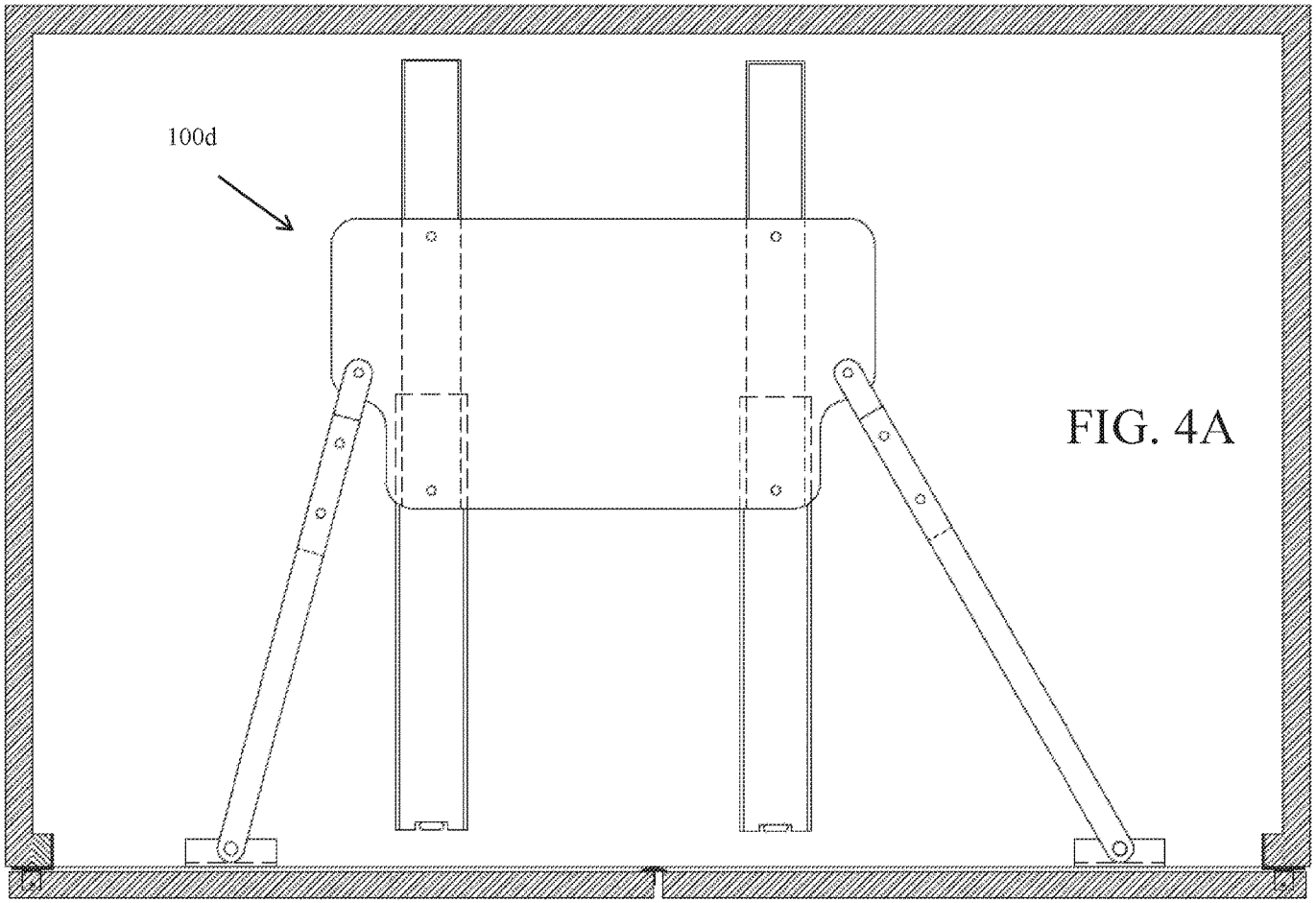
FIGS. 4A and 4B are non-limiting, exemplary illustrations of another embodiment of a device of the present invention for coordinated control and operation of double doors in accordance with one or more embodiments of the present invention.
Figure 4B:
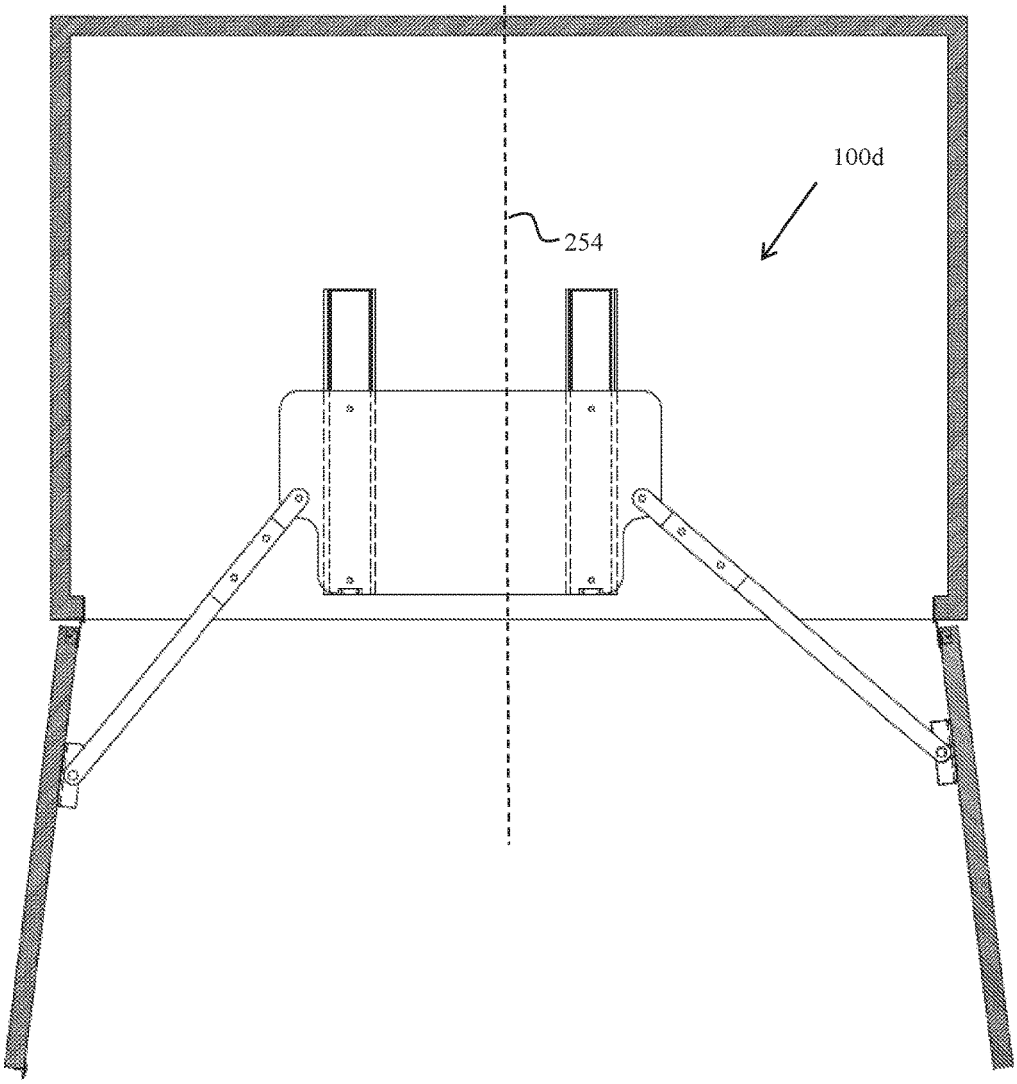

FIGS. 4A and 4B are non-limiting, exemplary illustrations another embodiment of a device of the present invention for coordinated control and operation of double doors in accordance with one or more embodiments of the present invention. The device 100*d* illustrated in FIGS. 4A and 4B includes similar corresponding or equivalent components, interconnections, functional, operational, and or cooperative relationships as devices 100*a*, 100*b*, and 100*c* that are shown in FIGS. 1A to 3B, and described above. Therefore, for the sake of brevity, clarity, convenience, and to avoid duplication, the general description of FIGS. 4A and 4B will not repeat every corresponding or equivalent component, interconnections, functional, operational, and or cooperative relationships that has already been described above in relation to devices 100*a*, 100*b*, and 100*c* that are shown in FIGS. 1A to 3B but instead, are incorporated by reference herein.

In this non-limiting, exemplary instance, device 100*d* uses a symmetrical plate 110*a* that is symmetrically associated with two linear facilitator 112*a* and 112*b*, the combination of which are asymmetrically associated with cabinet 108 as shown by cabinet 108 center 254 (FIG. 3B).

Figure 5A:
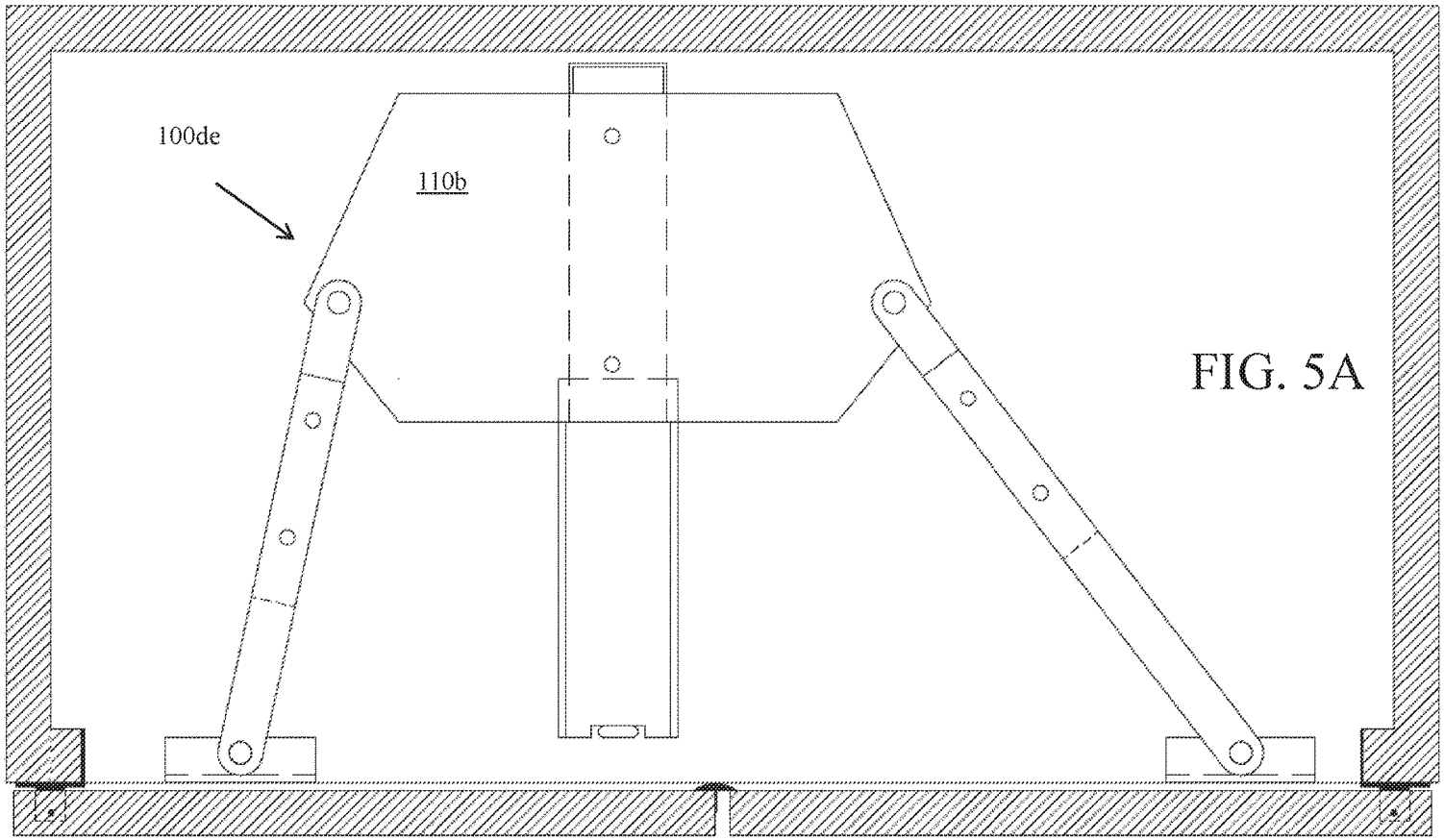
FIGS. 5A and 5B are non-limiting, exemplary illustrations of another embodiment of a device of the present invention for coordinated control and operation of double doors in accordance with one or more embodiments of the present invention.
Figure 5B:
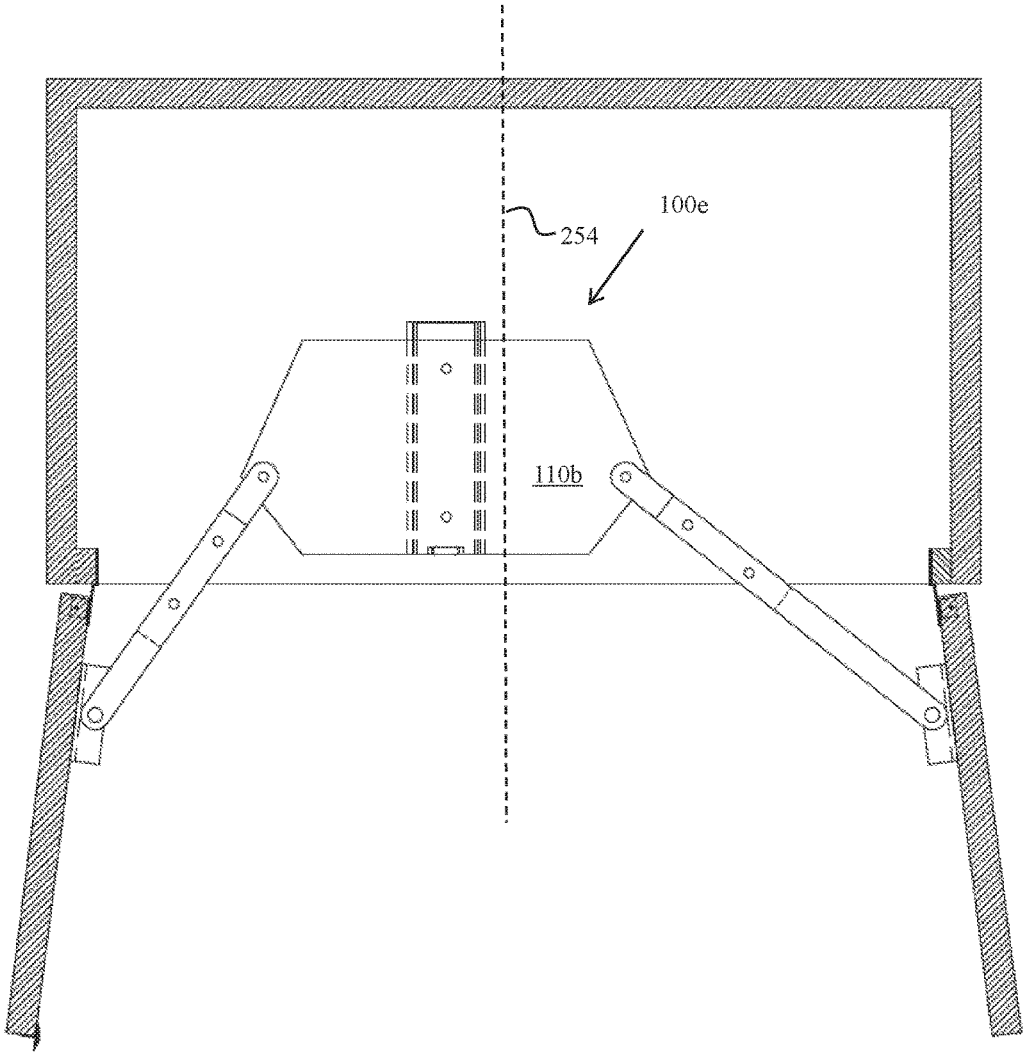

FIGS. 5A and 5B are non-limiting, exemplary illustrations another embodiment of a device of the present invention for coordinated control and operation of double doors in accordance with one or more embodiments of the present invention. The device 100*e* illustrated in FIGS. 5A and 5B includes similar corresponding or equivalent components, interconnections, functional, operational, and or cooperative relationships as devices 100*a*, 100*b*, 100*c*, and 100*d* that are shown in FIGS. 1A to 4B, and described above. Therefore, for the sake of brevity, clarity, convenience, and to avoid duplication, the general description of FIGS. 5A and 5B will not repeat every corresponding or equivalent component, interconnections, functional, operational, and or cooperative relationships that has already been described above in relation to devices 100*a*, 100*b*, 100*c*, and 100*d* that are shown in FIGS. 1A to 4B but instead, are incorporated by reference herein.

In this non-limiting, exemplary instance, device 100*e* uses a symmetrical plate 110*b* that has a different (polygonal) configuration that is symmetrically associated with a single linear facilitator 112, the combination of which are asymmetrically associated with cabinet 108 as shown by cabinet 108 center 254 (FIG. 5B).

Figure 6A:
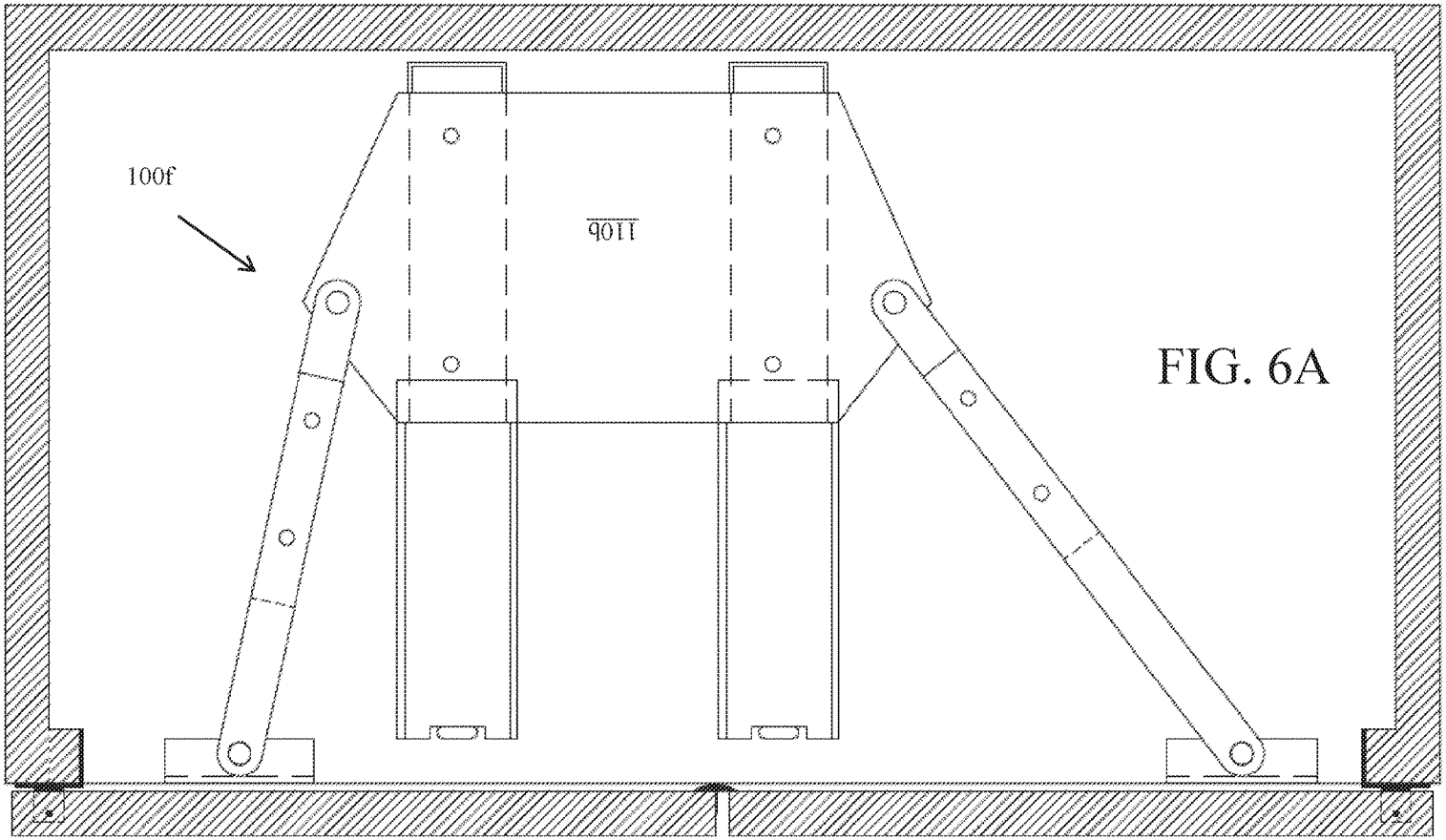
FIGS. 6A and 6B are non-limiting, exemplary illustrations of another embodiment of a device of the present invention for coordinated control and operation of double doors in accordance with one or more embodiments of the present invention.
Figure 6B:
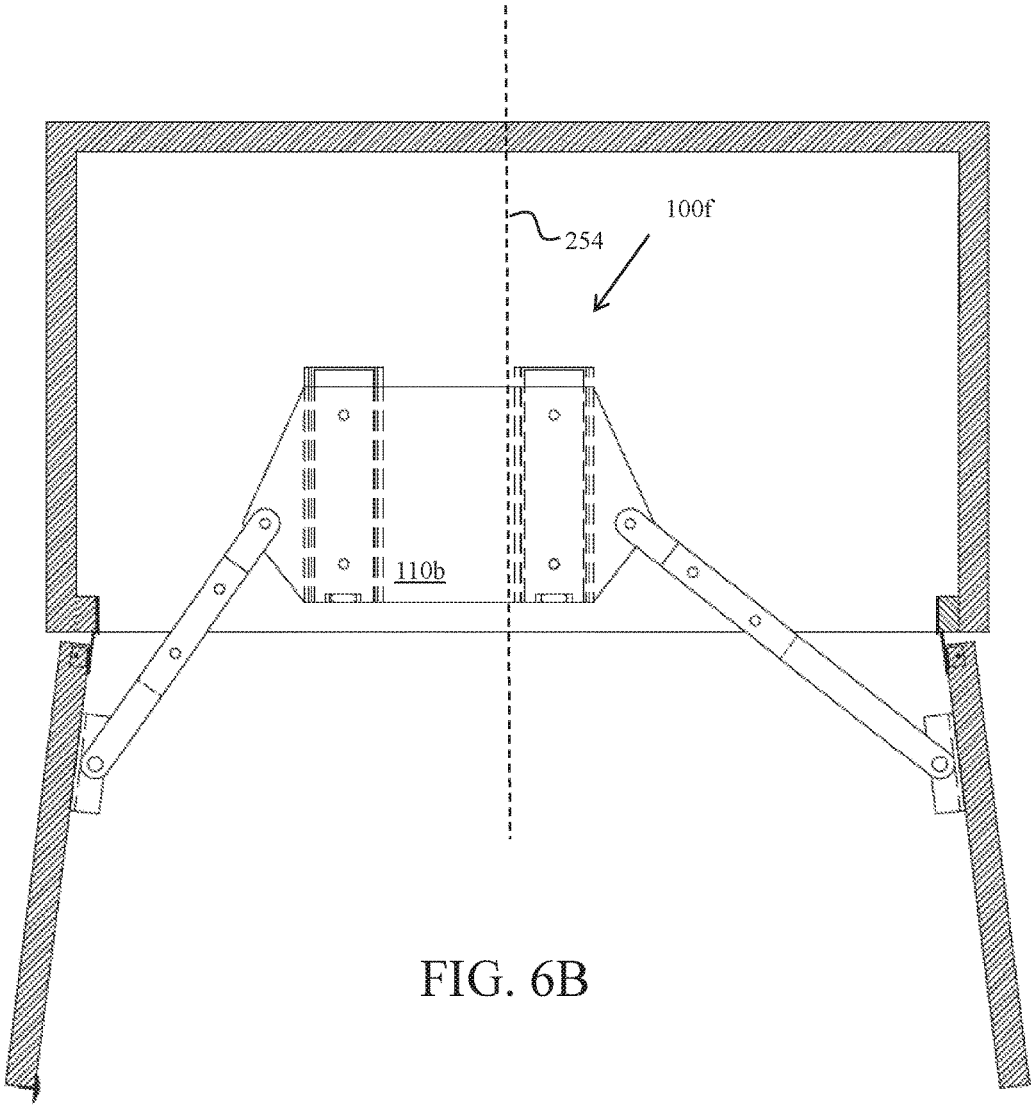

FIGS. 6A and 6B are non-limiting, exemplary illustrations another embodiment of a device of the present invention for coordinated control and operation of double doors in accordance with one or more embodiments of the present invention. The device 100*f* illustrated in FIGS. 6A and 6B includes similar corresponding or equivalent components, interconnections, functional, operational, and or cooperative relationships as devices 100*a*, 100*b*, 100*c*, 100*d*, 100*e* that are shown in FIGS. 1A to 5B, and described above. Therefore, for the sake of brevity, clarity, convenience, and to avoid duplication, the general description of FIGS. 6A and 6B will not repeat every corresponding or equivalent component, interconnections, functional, operational, and or cooperative relationships that has already been described above in relation to devices 100*a*, 100*b*, 100*c*, 100*d*, 100*e* that are shown in FIGS. 1A to 5B but instead, are incorporated by reference herein.

In this non-limiting, exemplary instance, device 100*f* uses a symmetrical plate 110*b* that has a different (polygonal) configuration that is symmetrically associated with a two linear facilitator 112*a* and 112*b*, the combination of which are asymmetrically associated with cabinet 108 as shown by cabinet 108 center 254 (FIG. 5B).

Figure 7:
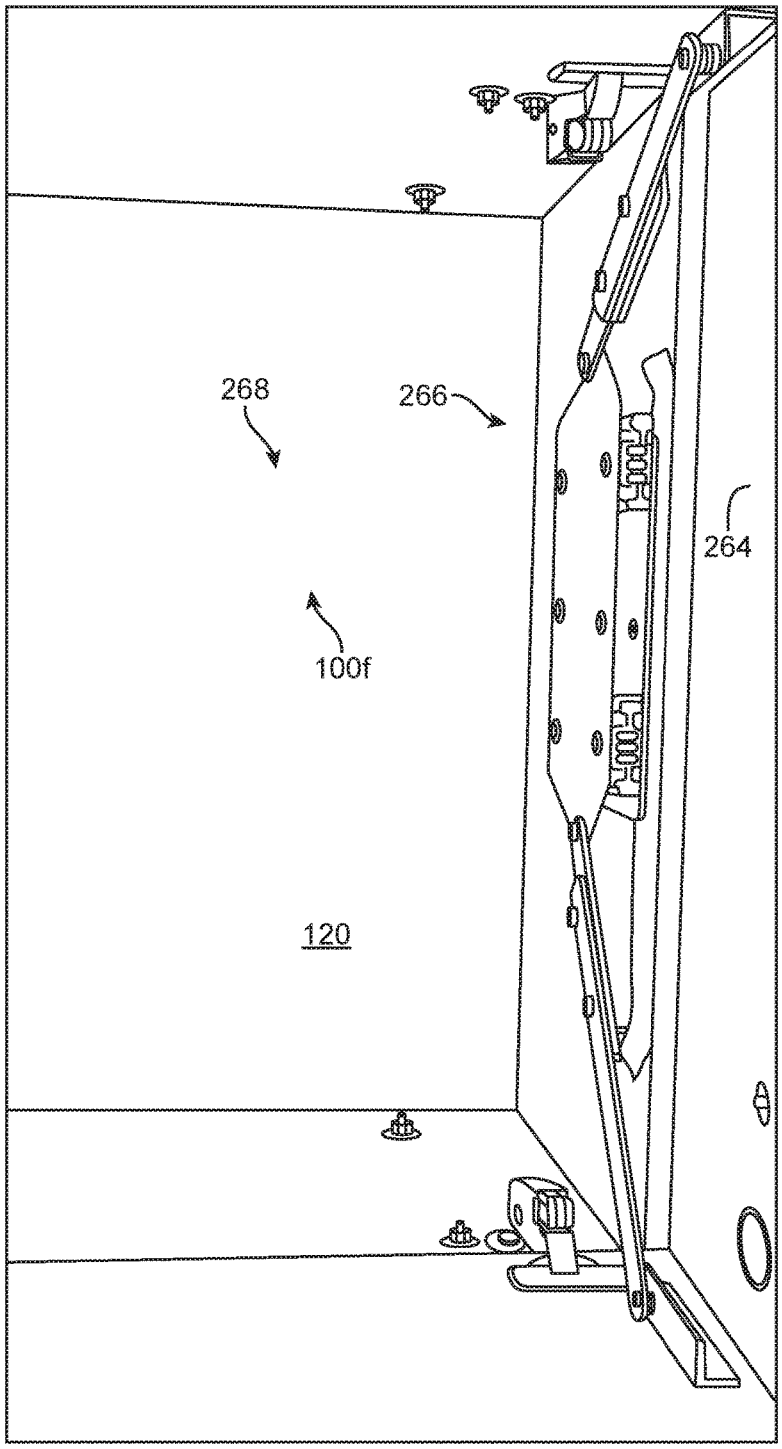
FIG. 7 is a non-limiting, exemplary illustration that shows a device of the present invention for coordinated control and operation of double doors installed on an interior top side of a cabinet in accordance with one or more embodiments of the present invention.

FIG. 7 is non-limiting, exemplary illustration that shows the installation and use of the device 100 of the present invention on an interior top (or interior ceiling) 264 of a wall mounted cabinet 266 rather than bottom side 128 in accordance with one or more embodiments of the present invention. Although in this non-limiting, exemplary instance device 100*f* is used as a representative, any one of the other illustrated devices 100*a* to 100*e* may also be used instead. It should be noted that an interior top installation of device 100 for wall mount cabinets 266 are preferred as the bottom side 128 is used to store items.

As further illustrated in FIG. 7, interior top installation of device 100 for wall mount cabinets 266 may optional include the use of installation plate 268 for easier installation of device 100 for existing installed wall hung cabinets. However, installation plate 268 would not be needed or required for new cabinet installations.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, with respect to FIGS. 1A to 2C, first and the second pivot opening may be positioned at respective first and second flanges that extend equally from the plate 110 at equal lengths, but are not aligned to provide for asymmetric actuation of the of the first and the second doors. In other words, for asymmetrical actuation, the amount of travel for one side for one door must be different from the other side. As yet another example, the first and the second pivot opening may be symmetrically positioned. As still another example, the plate (any one of the plates shown) may be symmetrically positioned in relation to the linear motion facilitator and the first and the second doors for symmetric actuation of the first and the second doors. Alternatively, the plate and the linear motion facilitator may be symmetrically positioned in relation to the first and the second doors for symmetric actuation of the first and the second doors. As another example, the plate may comprise of a rigid band that may be of "H" shape. Additionally, the astragal can be installed on either door. If the astragal is installed on the right door for example, the installation of the device will be installed in reverse as currently described so that the door with the astragal always closes first. Such variations and alternate embodiments are contemplated, and can be made without departing from the spirit and scope of the invention.

It should further be noted that throughout the entire disclosure, the labels such as left, right, front, back, top, inside, outside, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction, orientation, or position. Instead, they are used to reflect relative locations/positions and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

Further the terms "a" and "an" throughout the disclosure (and in particular, claims) do not denote a limitation of quantity, but rather denote the presence of at least one of the referenced item.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A device for coordinated control and operation of double doors, comprising:

a plate that is connected with a linear motion facilitator;

the linear motion facilitator is comprised of a slider, which is a ball bearing full extension slide fixed to one of an interior bottom and an interior top of a cabinet, while the plate is connected to a moving member of the ball bearing full extension slide, enabling a linear motion of the plate;

adjustable links that connect the plate to respective a first door and a second door;

the plate is comprised of:

a first and a second pivot openings that are connected to the adjustable links; and connection openings for connection of the plate with the linear motion facilitator;

wherein: both the first and the second doors are opened when one of the first or the second door is opened and are closed when one of the first or the second door is closed.

2. The device for coordinated control and operation of double doors as set forth in claim 1, wherein:

the first and the second pivot openings are positioned at respective first and second flanges that extend from the plate at unequal first and second lengths to provide for asymmetric actuation of the first and the second doors.

3. The device for coordinated control and operation of double doors as set forth in claim 1, wherein:

the first and the second pivot opening are positioned at respective first and second flanges that extend equally from the plate at equal lengths, but are not aligned to provide for asymmetric actuation of the of the first and the second doors.

4. The device for coordinated control and operation of double doors as set forth in claim 1, wherein:

the first and the second pivot opening are symmetrically positioned.

5. The device for coordinated control and operation of double doors as set forth in claim 1, wherein:

the plate is asymmetrically positioned in relation to the linear motion facilitator and first and second doors for asymmetric actuation of the first and the second doors.

6. The device for coordinated control and operation of double doors as set forth in claim 1, wherein:

the plate and the linear motion facilitator are asymmetrically positioned in relation to the first and the second doors for asymmetric actuation of the first and the second doors.

7. The device for coordinated control and operation of double doors as set forth in claim 1, wherein:

the linear motion facilitator includes sufficient width to prevent out of plane movement of the plate.

8. The device for coordinated control and operation of double doors as set forth in claim 1, wherein:

the slider of the linear motion facilitator includes sufficient width to prevent out of plane movement of the plate.

9. The device for coordinated control and operation of double doors as set forth in claim 1, wherein:

the slider of the linear motion facilitator is comprised of a first slider and a second slider.

10. The device for coordinated control and operation of double doors as set forth in claim 9, wherein:

the plate is asymmetrically secured onto the first and the second sliders.

11. The device for coordinated control and operation of double doors as set forth in claim 9, wherein:

the plate is symmetrically secured onto the first and the second sliders.

12. The device for coordinated control and operation of double doors as set forth in claim 1, wherein:

first ends of the adjustable links are connected to the respective first and second doors by brackets.

13. The device for coordinated control and operation of double doors as set forth in claim 1, wherein:

the adjustable links are comprised of:

a first member;

a second member; and a connecting member that connects the first and the second members.

14. The device for coordinated control and operation of double doors as set forth in claim 3, wherein:

the first member is an elongated piece that includes:

a first distal end opening at a first end for connection with one of first and second door; and an opening for connection with the second member.

15. The device for coordinated control and operation of double doors as set forth in claim 3, wherein:

the second member includes:

a second distal end opening for connection with the plate; and an adjuster opening for connection with the first member.

16. The device for coordinated control and operation of double doors as set forth in claim 15, wherein:

the adjuster opening is an elongated slot.

17. The device for coordinated control and operation of double doors as set forth in claim 3, wherein:

a connecting member includes a connector opening that is aligned with the opening of the first member and adjuster opening of the second member to secure first and second members by a coupler.

* * * * *